US006470166B2

(12) United States Patent
Mizoguchi et al.

(10) Patent No.: US 6,470,166 B2
(45) Date of Patent: Oct. 22, 2002

(54) COLOR IMAGE FORMING APPARATUS THAT MINIMIZES CONTACT BETWEEN TRANSFER BELT AND PHOTOSENSITIVE DRUM

(75) Inventors: Yoshihiro Mizoguchi, Fukuoka (JP); Tadashi Shimotoso, Fukuoka (JP); Takashi Yoshihara, Fukuoka (JP); Yuji Nagai, Fukuoka (JP); Kazuhiro Ogata, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/851,107

(22) Filed: May 9, 2001

(65) Prior Publication Data

US 2002/0018673 A1 Feb. 14, 2002

(30) Foreign Application Priority Data

May 11, 2000 (JP) ..... 2000-138658

(51) Int. Cl.[7] ..... G03G 15/01
(52) U.S. Cl. ..... 399/302
(58) Field of Search ..... 399/298, 299, 399/302, 303, 313, 312

(56) References Cited

U.S. PATENT DOCUMENTS 5,541,634 A * 7/1996 Otsuka et al. ..... 399/299
5,765,082 A * 6/1998 Numazu et al. ..... 399/299
5,893,017 A * 4/1999 Yamamoto ..... 399/299
6,029,023 A * 2/2000 Munemori et al. ..... 399/299
6,061,542 A * 5/2000 Minami et al. ..... 399/299
6,078,777 A * 6/2000 Imumi et al. ..... 399/313
6,108,510 A * 8/2000 Nakane ..... 399/298
6,134,402 A * 10/2000 Nakayama et al. ..... 399/299
6,201,944 B1 * 3/2001 Onuki et al. ..... 399/299
6,324,374 B1 * 11/2001 Sasamoto et al. ..... 399/298
6,349,192 B1 * 2/2002 Yoshino et al. ..... 399/302
6,356,732 B1 * 3/2002 Watanabe et al. ..... 399/299

FOREIGN PATENT DOCUMENTS

JP 11-15226 1/1999

* cited by examiner

*Primary Examiner*—Susan S. Y. Lee
(74) *Attorney, Agent, or Firm*—Wenderoth, Lind & Ponack, L.L.P.

(57) ABSTRACT

Disclosed here is a color-image forming apparatus that minimizes damage caused by friction between a photosensitive drum and an inter-stage transfer belt. The apparatus includes a plurality of image-forming units, each of which has the photosensitive drum carrying an electrostatic latent image thereon, a developing unit forming a toner image by applying toner to the latent image. Having different color toners therein, the image-forming units are organized into a tandem layout. The inter-stage transfer belt is looped over plural rollers to form an endless path. While traveling the path along the direction in which the image-forming units are arranged, the belt forms a full-color toner image thereon by transferring plural toner-images on the drums one upon another. The belt is controlled to come into contact with the drums only while accepting the toner image from the drums.

13 Claims, 19 Drawing Sheets

COLOR IMAGE FORMING APPARATUS THAT MINIMIZES CONTACT BETWEEN TRANSFER BELT AND PHOTOSENSITIVE DRUM

FIELD OF THE INVENTION

The present invention relates to a color-image forming apparatus equipped with a photosensitive drum and a transfer belt that forms an image by overlapping several pieces of image information through electro-photography and other technologies.

BACKGROUND OF THE INVENTION

In the prior-art color-image forming apparatus applying electro-photography, an image has been typically formed through the procedures below:

i) a charger charges a photosensitive drum serving as an image-carrier;

ii) with acceptance of laser radiation according to image information, the photosensitive drum forms an electrostatic latent image thereon;

iii) a developing unit develops the electrostatic latent image into a visible toner image; then iv) the visible toner image is transferred onto a sheet of paper or other sheet-type materials.

Responding to the needs for color image, many kinds of tandem type color-image forming apparatuses have been developed so far.

A typical tandem type apparatus has plural image-carriers—each carrier is responsible for carrying cyan-, magenta-, yellow-, and preferably black-images. The individual four images are formed on their respective carriers in the series of image-forming processes described above. All of the separately carried images are overlapped at a proper position of each carrier and transferred onto a recording material to form a full-color image.

In another tandem type color-image forming apparatus, the toner images formed on the respective image-carriers are temporarily transferred onto an inter-stage transfer member one upon another. After that, the overlapped full-color toner image is transferred onto a recording material in one operation.

Such a tandem type apparatus contributes to high-speed image forming due to its structure in which each color image has its specific image-forming section.

FIG. 20 shows a schematic diagram of the prior-art color-image forming apparatus. In the apparatus shown in FIG. 20, image-forming units 41, 42, 43, and 44 form toner images colored in black (K), cyan (C), magenta (M), and yellow (Y), respectively. According to an image signal from an exposure unit 45, photosensitive drums 41*a*, 42*a*, 43*a*, and 44*a* disposed in image-forming units 41, 42, 43, and 44, respectively, form each electrostatic latent image thereon. Inter-stage transfer belt 46 has a closed-loop structure. Transfer unit 47 transfers the respective toner images formed on drums 41*a*, 42*a*, 43*a*, and 44*a* onto belt 46. Fixing unit 48 finally transfers the toner image from belt 46 to sheet P fed from paper cassette 49 and fixes the image into place.

Here will be described the inner structure of image-forming units 41 through 44 in some detail. In image-forming unit 41 for black (K), for example, a laser beam from exposure unit 45 creates an electrostatic latent image over the peripheral surface of photosensitive drum 41*a*. Developing roller 41*c* applies toner onto the latent image formed on drum 41*a* to obtain a visible image. Cleaner 41*d* cleans out the residual toner on drum 41*a* after the toner image has been transferred onto belt 46. The procedure described above is performed in other units 42 through 44.

In such structured color-image forming apparatus, here will be described, for example, how the latent image carrying black component is formed on the drum.

Firstly, Charger 41*b* evenly charges over photosensitive drum 41*a* responsible for black. Then, according to image information from the host computer (not shown), exposure unit 45 applies laser light onto drum 41*a* to create a latent image. A thin layer of toner on developing roller 41*c* allows the latent image to be visible as a black-toner image. Having contact with drum 41*a*, inter-stage transfer belt 46 travels in the direction indicated by the arrow A shown in FIG. 20. The visible black-toner image is transferred onto belt 46 through the application of transferring pressure from the inside of belt 46 to transfer unit 47.

In the meantime, the latent image of the cyan component is created and then developed into a visible cyan-toner image with the help of cyan-toner layered on developing roller 42*c*. The cyan-toner image is transferred to belt 46 where the transfer process for the black-toner image has just been provided, thereby the two images are overlapped with each other.

In the same manner, the magenta- and the yellow-toner images are formed and overlapped with one after another. Thus, belt 46 carries the four-color overlapped image thereon.

The full-color toner image on belt 46 is finally transferred by transfer roller 50 onto sheet P coming from paper cassette 49. After that, sheet P travels through fixing unit 48 to have the toner image fixed thereon, and goes out in the direction B shown in FIG. 20.

After the toner image has been transferred onto sheet P, the residual toner on belt 46 is cleared out by belt cleaner 51.

According to the prior-art apparatus, however, its structure—the photosensitive drum contacting with the inter-stage transfer belt at all times—can raise a problem. If there is a difference in speed between the rotation of the drum and the running of the transfer belt, damage or wear can occur on the surfaces rubbing against each other, which may result in degradation in image quality or loss of life.

A suggestion that the drive timing of the drum should agree with that of the belt may be a remedy for the problem described above. However, initiating the operation of the two units with exact same drive-timing is practically impossible due to time-lags of the driving systems—delay in response of a motor, gears, and an actuator—of the drum and the belt. Therefore, minute abrasion will persist in such a situation.

Besides, electric current required to drive a motor sees its peak just at the beginning of rotation. Therefore, a surge of power would be the result if such driving devices started their operations in unison.

Furthermore, even in the case that only one color, for example, monochrome (usually, black) print is required, other image-forming units—units for cyan, magenta, and yellow—also have to work with an "idle" printing motion. This wasteful motion produces friction between the members forming the photosensitive drum, the developing roller, and the cleaner, thereby shortening their useful life.

In the event of an interruption of the printing due to paper jamming or other malfunctions, the toner image left of the drum and the inter-stage transfer belt has to be cleaned out for the next printing. Being typical of the structure of the tandem type apparatus, the transfer belt requires a much longer time to travel one rotation than the drum needs to rotate one turn. That is, the drum unnecessarily has to have several turns while the belt travels at least one rotation. This structural inconvenience also causes friction between parts forming the image-forming units, thereby reducing their longevity.

SUMMARY OF THE INVENTION

The object of the present invention is to provide a color-image forming apparatus having a structure that minimizes damage in the photosensitive drum and the inter-stage transfer belt due to friction occurring between them.

The apparatus of the present invention includes an exposure unit, plural image-forming units, and an endless inter-stage transfer belt.

The image-forming units are organized in a tandem type arrangement, and each contains: i) it's own photosensitive drum on which an electrostatic latent image is formed by the exposure unit; and ii) it's own developing unit for forming a toner image by applying toner onto the latent image. In addition, each unit has toner of a different color. Looped over plural rollers in its traveling path, the endless inter-stage transfer belt rotates to run along the direction of the arrangement of the image-forming units. A full-color toner image is formed on the belt as it runs, thereby overlapping the toner images formed on the drums upon another.

In the process, the belt comes into contact with the drum only while the toner image is transferred from the drum onto the belt. Keeping the belt from contact with the drum except for during the transfer process of the toner image reduces damage or abrasion from friction between the drum and the belt at the start of rotation. That is, the image-forming unit and the transfer belt have a longer service life.

DESCRIPTION OF THE PREFERRED EMBODIMENTS

Figure 1:
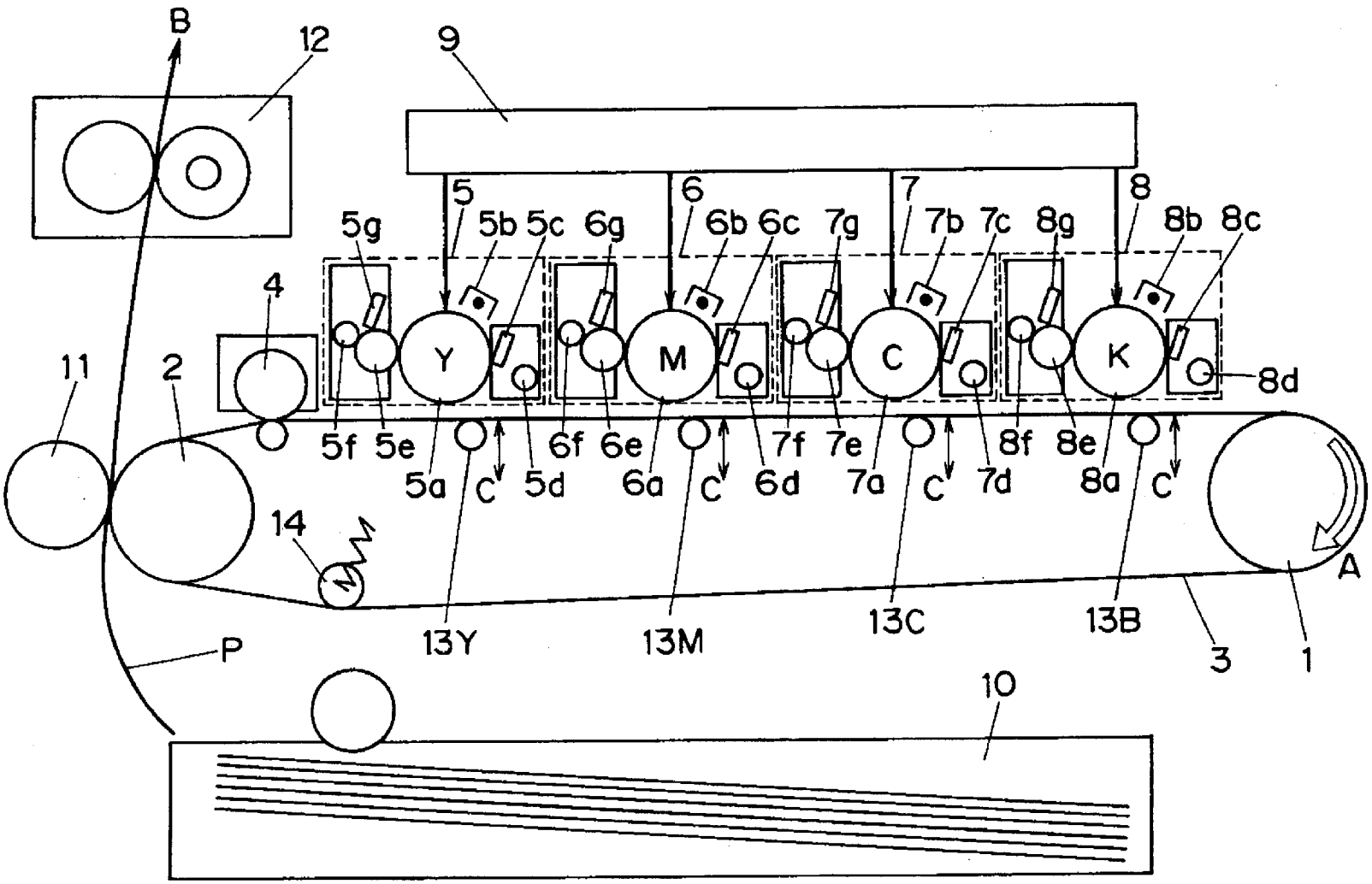
FIG. 1 shows a schematic diagram illustrating the structure of the color-image forming apparatus in accordance with a first preferred embodiment of the present invention.

The preferred embodiments of the present invention are described hereinafter with reference to the accompanying drawings, FIG. 1 through FIG. 19. As for the members that are the same as other members throughout the drawings, the same reference numerals will be provided and duplicate description thereof will be omitted.

First Preferred Embodiment

FIG. 1 shows a schematic diagram illustrating the structure of a color-image forming apparatus in accordance with a first preferred embodiment of the present invention.

As shown in FIG. 1, the apparatus includes an inter-stage transfer belt 3 driven by a belt-drive roller 1. Belt 3 is looped over belt-drive roller 1, a belt-support roller 2, and a tension roller 14 applying proper tension to belt 3.

A paper cassette 10 is located below the endless path of belt 3. A sheet P fed from paper cassette 10 travels between a second transfer roller 11 and belt 3 and reaches a fixing unit 12.

An exposure unit 9, which applies laser radiation according to image information, is disposed above belt 3. Between exposure unit 9 and belt 3, image-forming units 5, 6, 7, and 8, which are responsible for yellow (Y), magenta (M), cyan (C), and black (K), respectively, are arranged along a traveling direction of belt 3.

After being nipped between second transfer roller 11 and belt 3, sheet P accepts the color toner image formed on belt 3. The transferred toner image is fixed onto sheet P by fixing unit 12.

A belt cleaning unit 4 is disposed between image-forming unit 5 and belt-support roller 2. It clears out the residual toner image from belt 3.

It will be understood that the present invention comprehends any arrangement, given an image-forming unit for black, i.e., monochrome print, and at least two different colors such as yellow, and the structure is not limited to the structure demonstrated in the embodiment.

Identically structured image-forming units 5 through 8 include each photosensitive unit and developing unit.

In the photosensitive unit, corona type chargers 5*b*, 6*b*, 7*b*, 8*b* evenly charge photosensitive drums 5*a*, 6*a*, 7*a*, 8*a*, and their surfaces, respectively. Cleaning blades 5*c*, 6*c*, 7*c*, and 8*c* clear out the residual toner from the surfaces of drums 5*a*, 6*a*, 7*a*, and 8*a*, respectively. The waste toner collected by cleaning blades 5*c*, 6*c*, 7*c*, and 8*c* is then carried by waste toner screws 5*d*, 6*d*, 7*d*, and 8*d*, respectively.

On the other hand, in each developing unit, developing rollers 5*e*, 6*e*, 7*e*, and 8e apply toner to each electrostatic latent image formed on drums 5*a* through 8*a*, respectively, allowing the latent images to be visible. Supply rollers 5*f*, 6*f*, 7*f*, and 8*f* supply each surface of developing rollers 5*e* through 8*e*, respectively, with toner from the toner tank (not shown). Spreading blades 5*g*, 6*g*, 7*g*, and 8*g* evenly spread the toner on rollers 5*e* through 8*e*, respectively, and apply a charge to them.

Corresponding to drums 5*a*, 6*a*, 7*a*, and 8*a*, first transfer rollers—movable rollers—13Y, 13M, 13C, 13B are disposed on the side of the inner radius of the traveling path of inter-stage transfer belt 3. Each of rollers 13Y through 13B has an engaging/disengaging mechanism working in the direction of the inner radius of belt 3—indicated by double-headed arrow C in FIG. 1, controlling belt 3 to come into contact with or to keep away from drums 5*a*, 6*a*, 7*a*, and 8*a*, respectively. Rollers 13Y through 13B are made of metal. The latent images carried on drums 5*a* through 8*a* can be transferred onto belt 3 by applying a high voltage to each of the first transfer rollers. The structure therefore realizes a compact-sized transfer-mechanism section without an extra transferring member that is required in the prior-art apparatus.

As a variation of the mechanism for contacting transfer belt 3 with drums 5*a* through 8*a*, a structure can be employed for the same transferring effect, such that image-forming units 5 through 8 move in the vertical direction to come into contact with first transfer rollers 13Y through 13B that are fixed in place. However, moving units 5 through 8 in the vertical direction inevitably takes drums 5*a* through 8*a* with them. This can produce variations in obtaining correct focus by exposure unit 9 for latent-image formation. Such a structure can also produce unstable driving in the driving system responsible for rotating drums 5*a* through 8*a*.

Considering the inconveniencies described above, the embodiment employs the structure having movable first transfer rollers 13Y through 13B disposed on the inner-radius side of transfer belt 3, allowing belt 3 to contact with drums 5*a* through 8*a*.

Figure 2A:
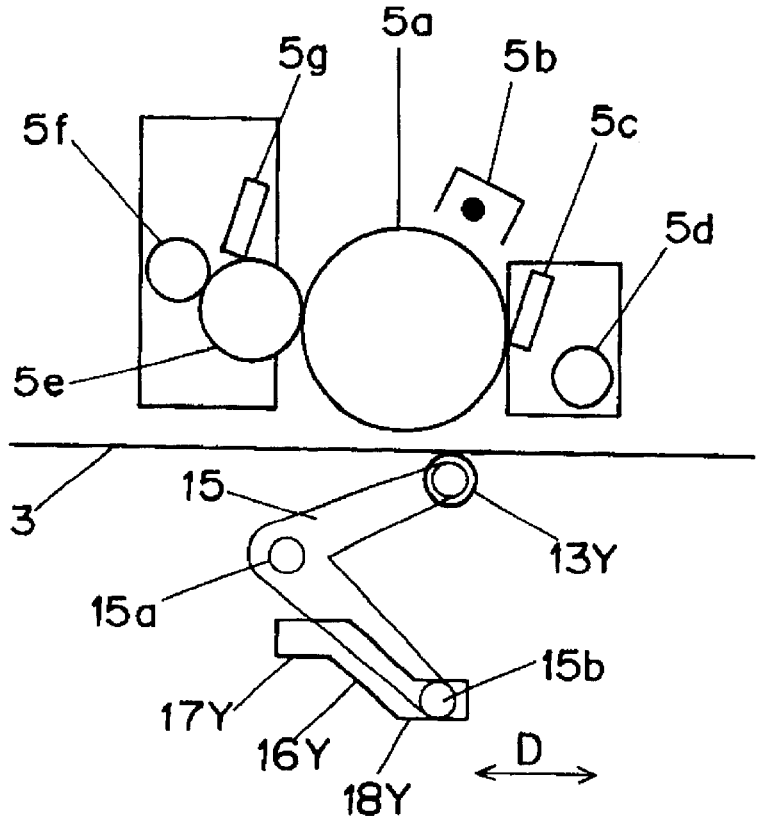
FIGS. 2(*a*) and 4(*b*) illustrate the image-forming unit for yellow and the engaging/disengaging mechanism of a first transfer roller in the apparatus.
Figure 2B:
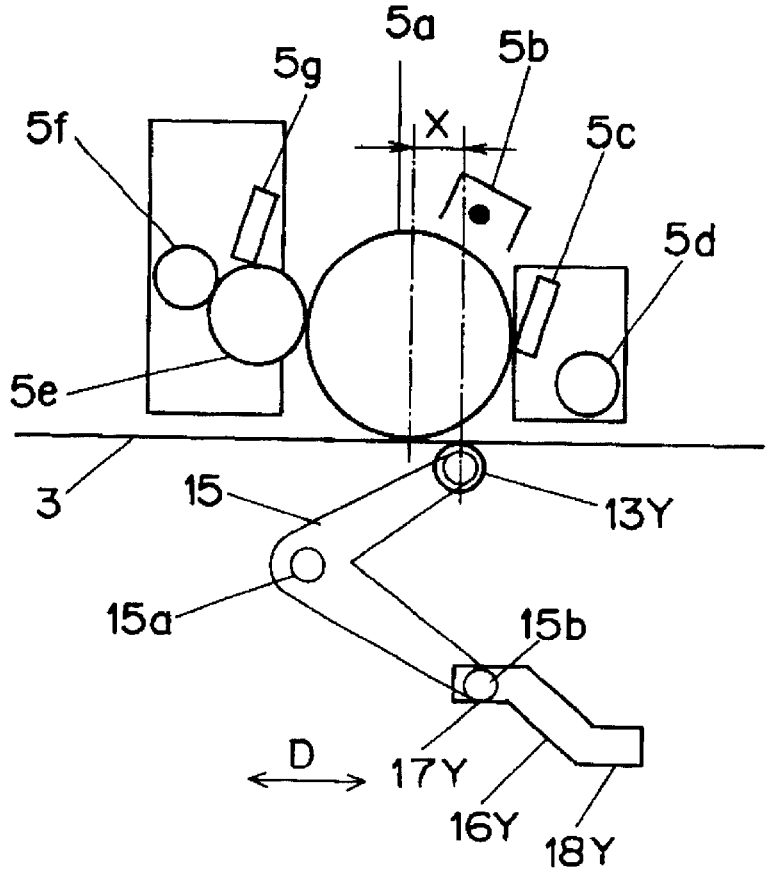

FIG. 2 illustrates the image-forming unit for yellow and the engaging/disengaging mechanism of a first transfer roller.

As shown in FIG. 2, transfer roller 13Y is rotatably held at its both ends by a trigger 15. Generally L-shaped, trigger 15 is rotatable about support pin 15*a* fixed at the bending section of trigger 15 to the apparatus. In the direction opposite to transfer roller 13Y, guide pin 15*b* is disposed at a position properly spaced from pin 15*a*. Controlling the position of pin 15*b* can set roller 13Y in place. Therefore, a guide 16Y for controlling the position of pin 15*b* is arranged to be slidable in the direction indicated by the arrow D.

Guide 16Y contains apertures in which guide pin 15*b* is accepted and a ramp. As the shape of the opening is shown in FIG. 2, guide 16Y contains engaging stage 17Y and disengaging stage 18Y, which are provided in a parallel arrangement with respect to the sliding direction. Sliding motion of guide 16Y allows trigger 15 to rotate about pin 15*a*.

The guiding operation will now be explained in a little more detail. When guide pin 15*b* stays on disengaging stage 18Y, as shown in FIG. 2(*a*), first transfer roller 13Y is also in the disengaging position, which keeps inter-stage transfer belt 3 away from photosensitive drum 5*a*. On the other hand, in the state shown in FIG. 2(*b*), when guide 16Y slides in the right direction from the state shown in FIG. 2(*a*), guide pin 15*b* moves to engaging stage 17Y. At this time, roller 13Y pushes belt 3, as well as rotates to the engaging position, and reaches a predetermined bite level with respect to drum 5*a*, allowing belt 3 to come into contact with drum 5*a*.

Photosensitive drum 5*a* is a delicate part that has an aluminum base over which a thin layer of an organic photo conductor or other photosensitive layer is provided. In order to protect drum 5*a* from damage, the contact position of roller 13Y with belt 3 is shifted from the contact position of drum 5*a* with belt 3 by distance X. This displacement thus avoids contacting drum 5*a* with roller 13Y via belt 3.

Roller 13Y may be formed by wrapping a metallic core with elastic members, such as foam and rubber, into a roll shape. Such structured roller 13Y can bite and come into contact with drum 5*a* via belt 3 due to its soft structure. With the structure, however, the elastic member has to be consistently controlled, for example, in its foam density, hardness, and resistance value. Variations in such factors can adversely affect the transfer characteristics, which fail to transfer an image to a desired position. Furthermore, this produces a disturbance in the transferred toner image, resulting in quality deficiencies in image. For this reason, roller 13Y is preferable made of metal.

As described above, by engaging guide pin 15*b* of trigger 15 with guide 16Y having engaging stage 17Y and disengaging stage 18Y, trigger 15 can be rotatably operated according to the movement of guide 16Y in the rightward/leftward direction. This allows belt 3 to come into contact with or to keep away from drum 5*a*. The structure—operating first transfer roller 13Y to be rotatable about support pin 15*a* with the help of trigger 15 and guide 16Y—is also employed for other transfer rollers 13M, 13C, and 13B in the same way.

Figure 3:
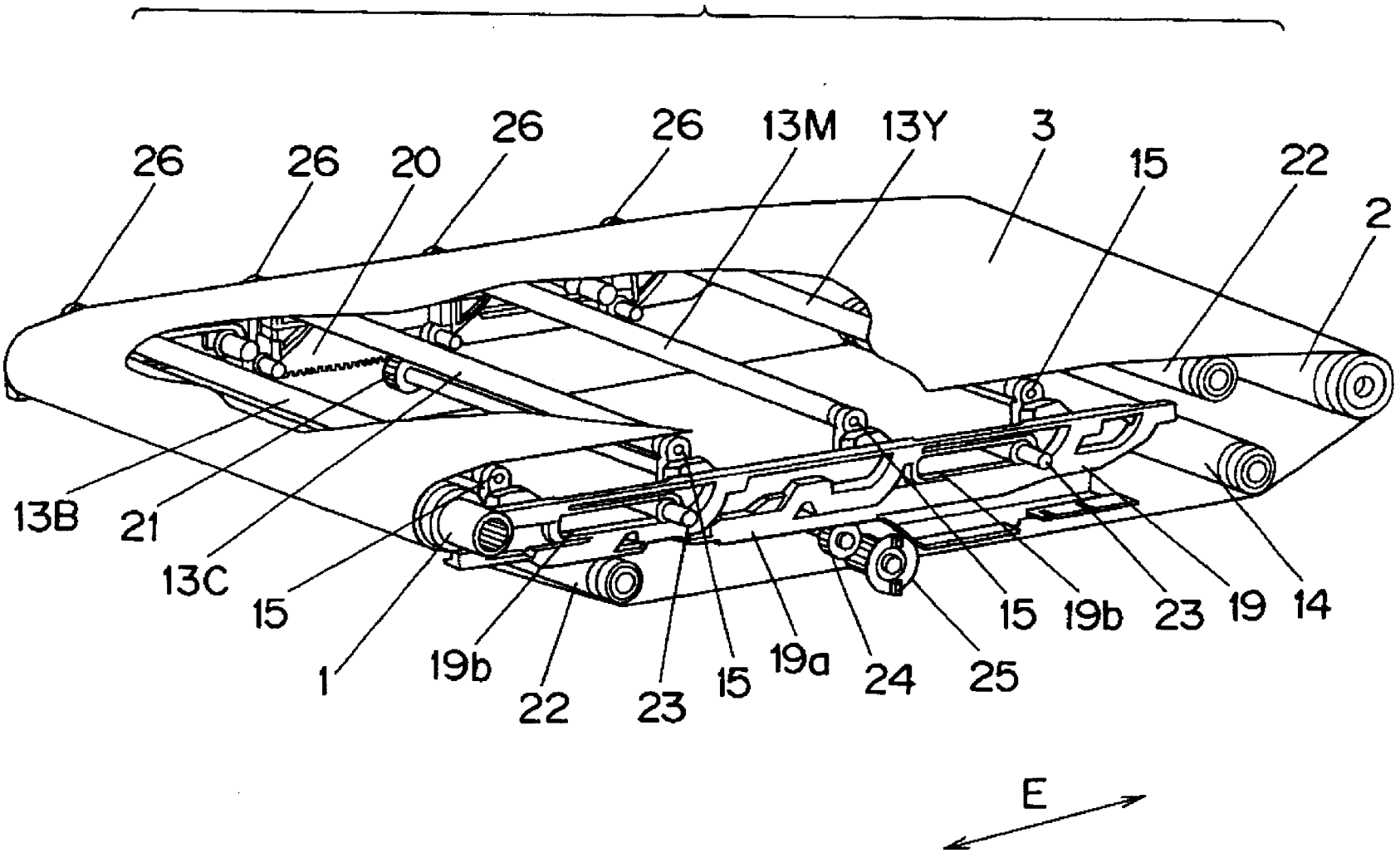
FIG. 3 is a perspective view indicating the essential part of an inter-stage transfer belt unit of the apparatus.
Figure 4:
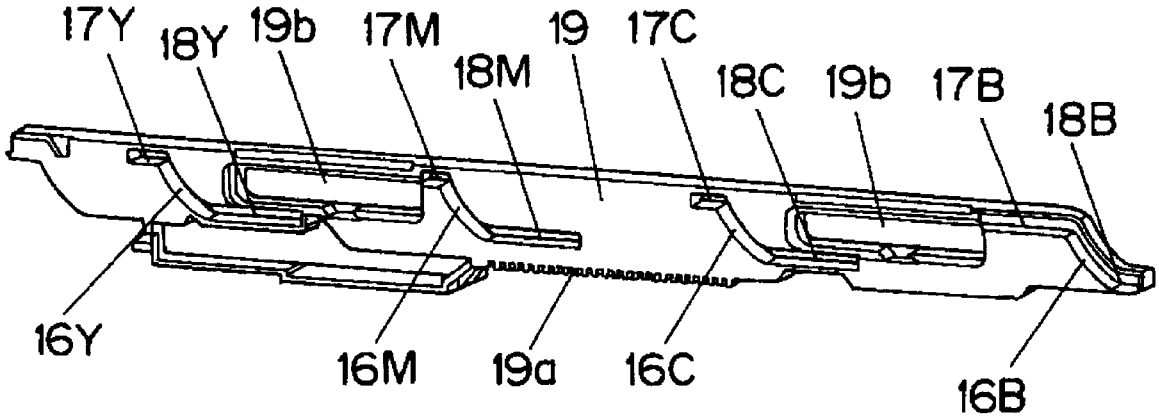
FIG. 4 is a perspective view indicating a guide member of the transfer belt unit.
Figure 5:
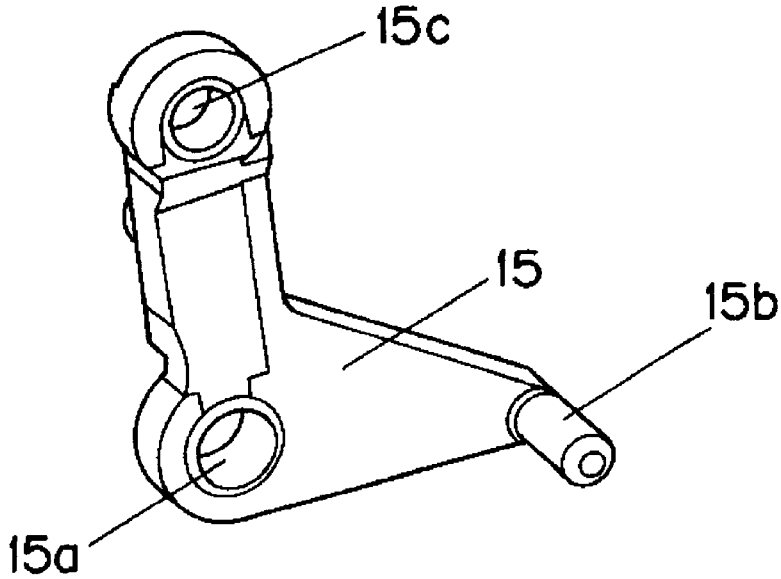
FIG. 5 is a perspective view indicating a trigger of the belt unit.

FIGS. 3, 4, and 5 are perspective views indicating the essential part of an inter-stage transfer belt unit, a guide member of the belt unit, and a trigger of the belt unit, respectively.

FIG. 3 shows the structure of inter-stage transfer belt unit 21, in which inter-stage transfer belt 3 is looped over i) belt-drive roller 1, ii) belt-support roller 2, iii) a tension roller 14, and iv) an idle roller 22 so as to travel about the endless path. Inside the endless path, first transfer rollers 13Y through 13B are arranged. For convenience's sake, the frame by which the rollers are fixed —the foundation of unit 21—is not shown in the figure.

Guide member 19 is located along one of the widthwise ends of belt 3 so as to be slidable in the direction indicated by the arrow E, i.e., in an orthogonal direction with respect to the rows of image-forming units 5 through 8. On the other widthwise end of belt 3, guide member 20 is located in symmetric relation to member 19.

On the inner side of guide member 19, four guides 16Y, 16M, 16C, and 16B are formed corresponding to the positions of image-forming units 5 through 8. Member 19 also has rack 19*a* at its bottom edge, and two slots 19*b* that accept two guide-holding pins 23 formed on unit 21. Rack 19*a* engages with pinion 24 that is rotatably arranged on the side of unit 21. Pinion 24 further meshes with joint gear 25 engaging with the driving system (not shown) for the apparatus. This engagement allows joint gear 25 to rotate forward or backward according to the driving control transmitted from the apparatus, and guide member 19 accordingly slides in the direction indicated by the arrow E.

Guide members 19 and 20 should operate in an exactly synchronized motion. To ensure the in-phase movement, guide members 19, 20 and pinion 24 each have inscribed markings (not shown) for their proper positioning.

Trigger 15 is, as illustrated in FIG. 2, generally L-shaped. In FIG. 5, trigger 15 includes i) support pin 15*a* on which trigger 15 rotates; ii) guide pin 15*b;* and iii) roller bearing 15*c* to accept first transfer rollers 13Y, 13M, 13C, 13B. At each position corresponding to respective image-forming units 5 through 8 disposed above inter-stage transfer belt 3, a pair of triggers 26, each of which has a symmetrical shape with trigger 15, is arranged so as to sandwich belt 3. Engaged with the sliding motion of guide members 19 and 20, triggers 15 and 26 have in-phase rotation. Therefore, when the movement of guide member 19 engaged with trigger 15 is mentioned in the explanation of the present invention, it implies that guide member 20 and trigger 26 have in-phase rotation as well.

Figure 6:
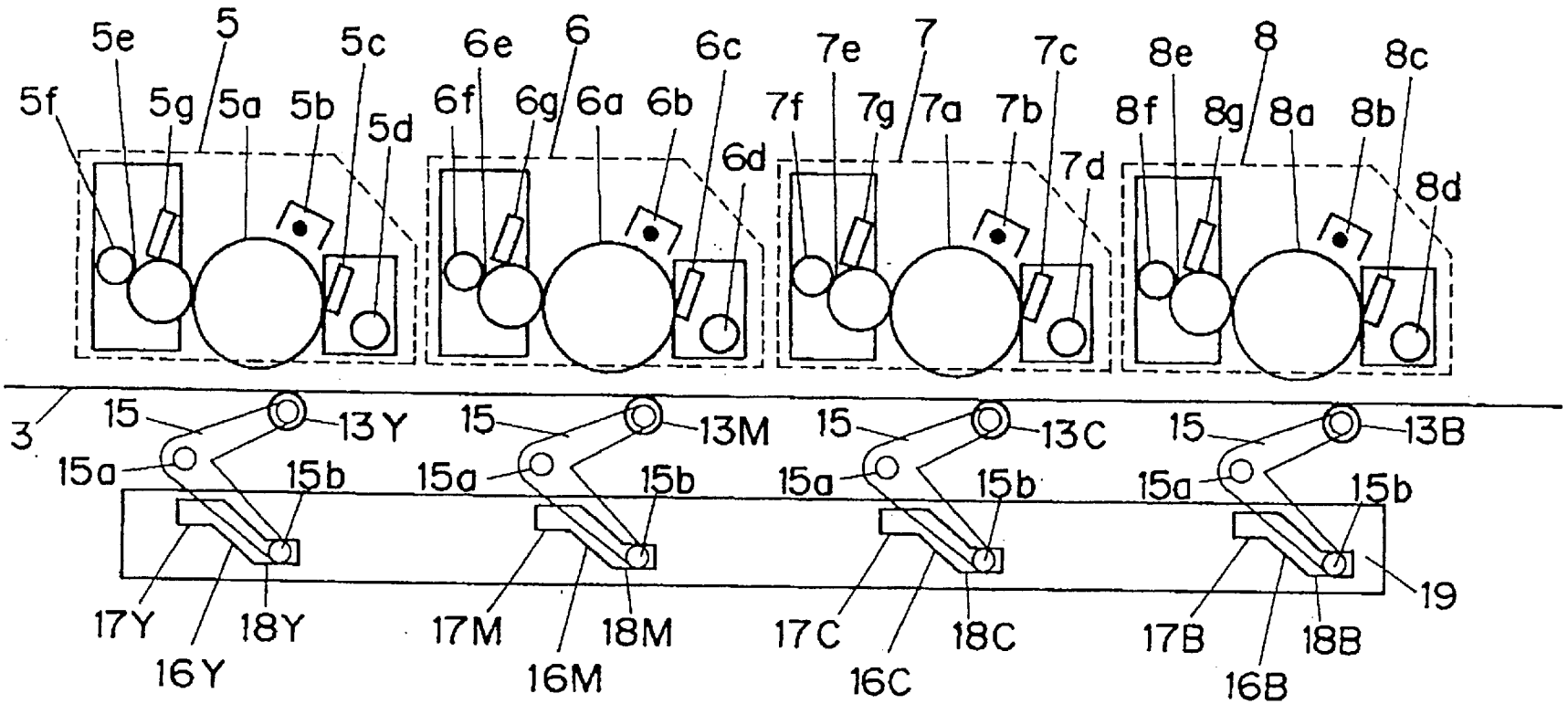
FIG. 6 is a schematic view of the color-image forming apparatus, specifically showing the engaging relation between the trigger and the guide member when all of the first transfer rollers stay in the disengaging positions.

FIG. 6 is a schematic view showing the engaging relation between the trigger and the guide member when all of the first transfer rollers stay in the disengaging positions. Image-forming units 6 through 8 in the figure have the same structure as unit 5 for yellow (Y) shown in FIG. 2. The engagement between guide pin 15*b* of trigger 15 and each of guides 16Y, 16M, 16C, and 16B formed on guide member 19 is the same as that shown in FIG. 2. That is, each guide pin 15*b* stays at disengaging stages 18Y through 18B of guides 16Y through 16B, first transfer rollers 13Y through 13B also stay in disengaging positions, thereby keeping belt 3 away from photosensitive drums 5*a* through 8*a*.

Figure 7:
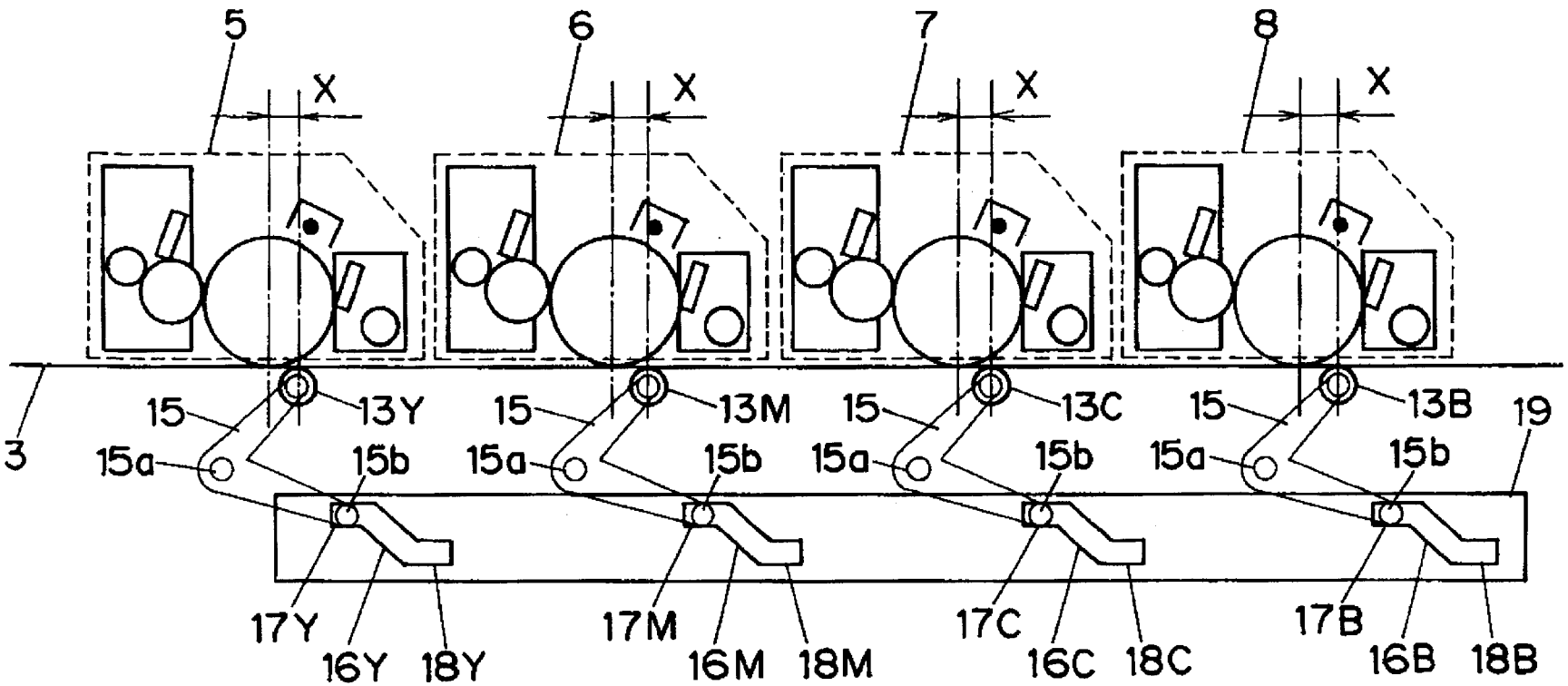
FIG. 7 is a schematic view of the apparatus, specifically showing the engaging relation between the trigger and the guide member when all of the first transfer rollers stay in the engaging positions.

FIG. 7 is a schematic view showing the engaging relation between the trigger and the guide member when all of the first transfer rollers stay in the engaging positions. As shown in the figure, the sliding motion of guide member 19—the rightward sliding from the state shown in FIG. 6—slides each guide pin 15*b* up to engaging stages 17Y through 17B via the ramp formed on respective guides 16Y through 16B. First transfer rollers 13Y through 13B accordingly move into the engaging positions, by which belt 3 comes into contact with drums 5*a* through 8*a*.

Figure 8:
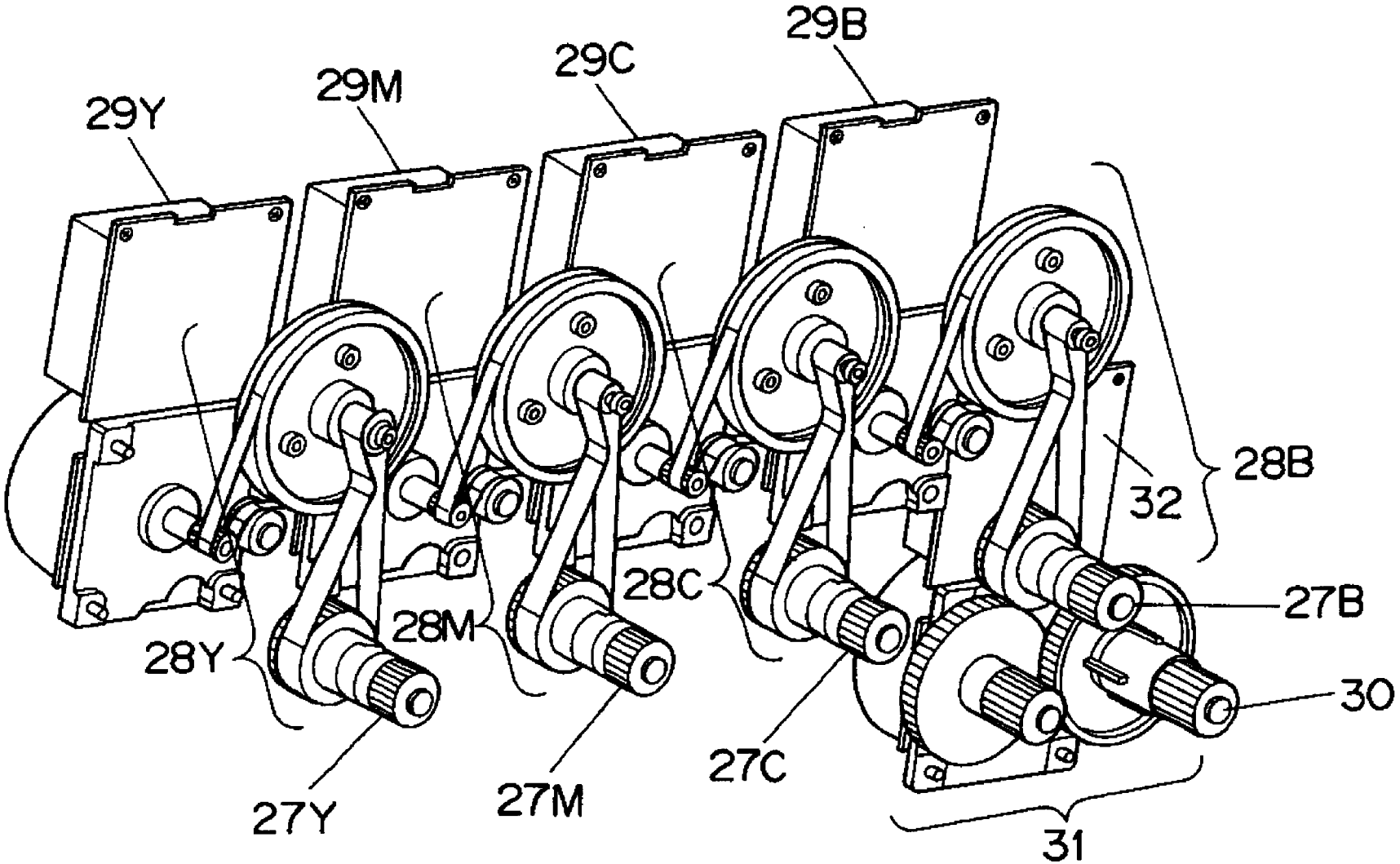
FIG. 8 is a perspective view indicating driving units of the apparatus.

FIG. 8 is a perspective view indicating driving units of the color-image forming apparatus. In FIG. 8, drum-joint gears 27Y, 27M, 27C, and 27B are male coupling members having involute toothed edges on their outer surfaces. Belt modules 28Y, 28M, 28C, 28B—a combination of timing belts and pulleys—and drum motors (i.e., drum drivers) 29Y, 29M, 29C, 29B are disposed corresponding to each of drum-joint gears 27Y through 27C. Rotational force generated by drum motors 29Y through 29B is transmitted to drum-joint gears 27Y through 27B via belt modules 28Y through 28B, respectively. The driving unit also includes belt-joint gear 30, belt module 31 for driving gear 30, and belt motor (i.e., belt driver) 32. Like the drum-joint gear, belt-joint gear 30 is a male coupling member having an involute-toothed edge on its outer surface.

Figure 9:
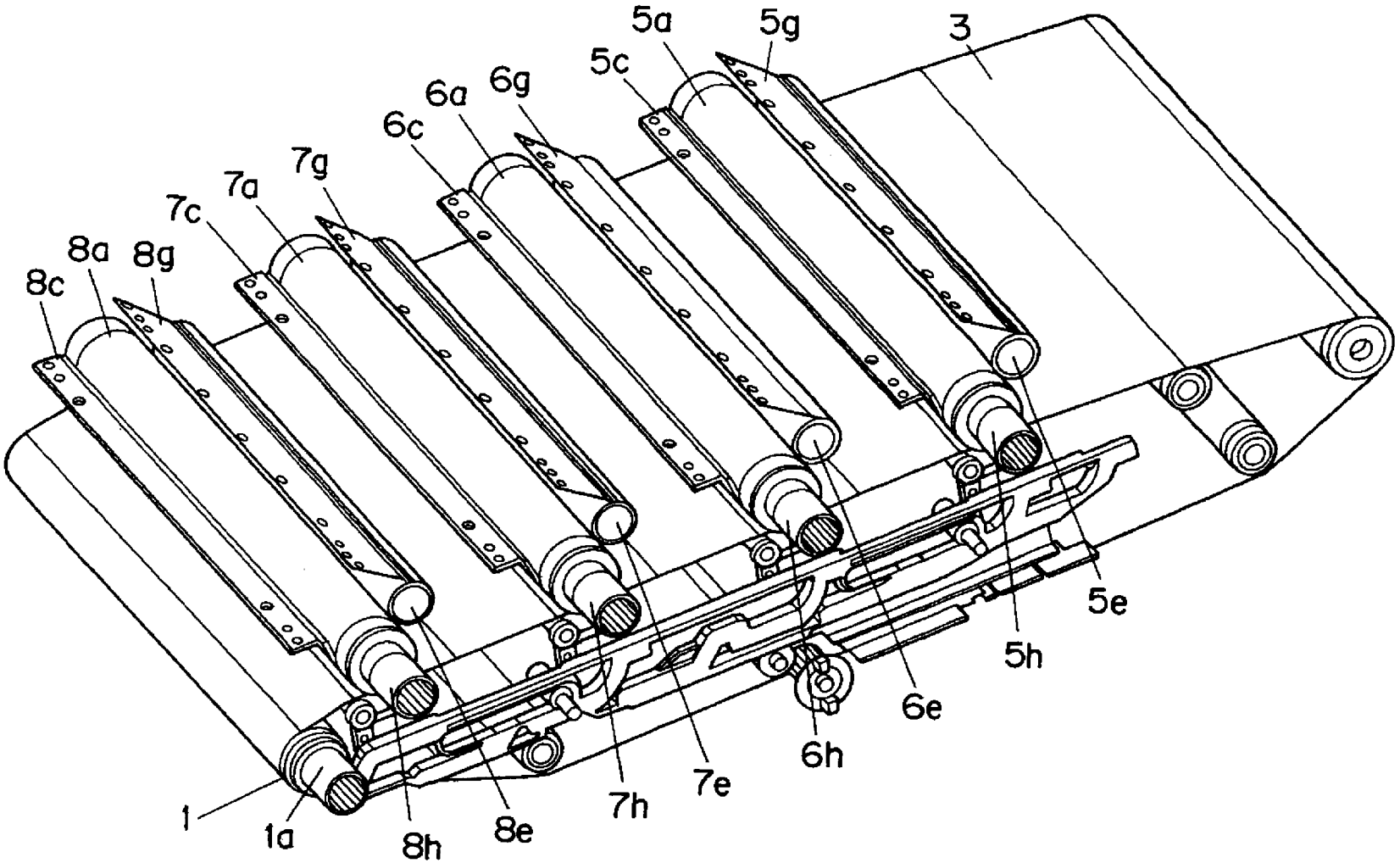
FIG. 9 is a perspective view indicating the positional relation between the inter-stage transfer belt and the image-forming unit in the apparatus.
Figure 10:
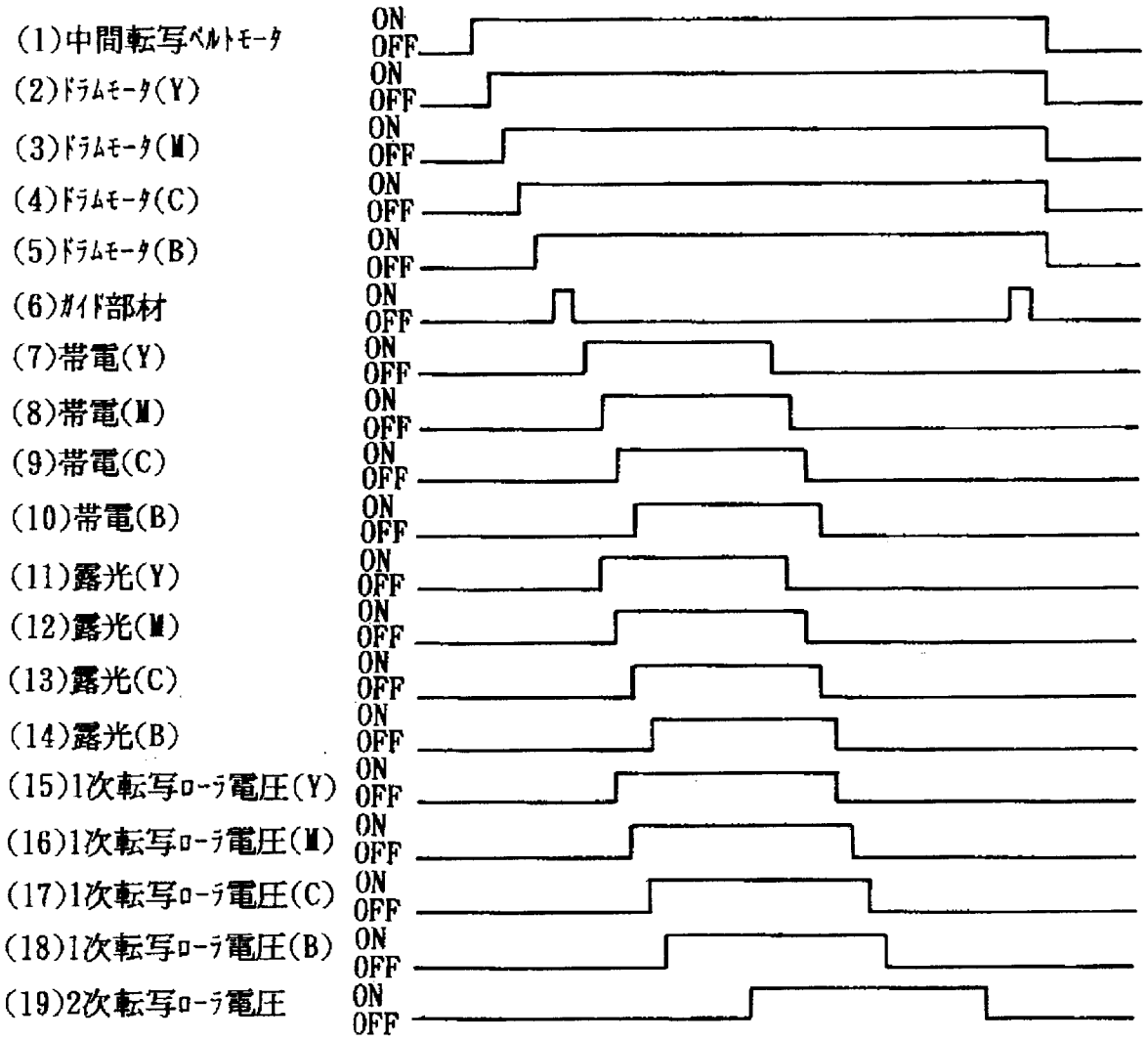
FIG. 10 is a timing chart indicating the operation of the apparatus.

FIG. 9 is a perspective view indicating how the inter-stage transfer belt unit is arranged with respect to the image-forming unit.

As shown in the figure, photosensitive drums 5*a* through 8*a* have coaxially arranged drum gears 5*h, 6*h, 7*h,* and 8*h* on their one end. Each drum gear has a female coupling section with its inner surface involute-toothed. Drum gears 5*h, 6*h, 7*h,* and 8*h* engage with drum-joint gears 27Y, 27M, 27C, and 27B in FIG. 8, respectively. Belt-drive roller 1 has coaxially arranged belt gear 1*a* on its one end. Belt gear 1*a* has a male coupling section whose inner surface is edged with involute-teeth to engage with belt-joint gear 30.

Now will be described how these units work. Responding to the print-start signal, belt motor 32 runs belt 3 in the direction indicated by the arrow A in FIG. 1. Then, drum motors 29Y through 29B start to rotate drums 5*a* through 8*a*. After that, the driving system of the apparatus transmits a driving force via joint gear 25 to pinion 24, thereby starting guide member 19 to slide from the position shown in FIG. 6—the initial position—to its stroke-end. With the sliding motion of guide member 19, each guide pin 15*b* travels each ramp of guide 16Y through 16B and reaches engaging stages 17Y through 17B. As guide pins 15*b* move, first transfer rollers 13Y through 13B rotate on support pins 15*a* to their engaging positions. Belt 3 comes into contact with drums 5*a* through 8*a,* as shown in FIG. 7.

In image-forming unit 5, charger 5*b* evenly charges the surface of drum 5*a*. According to yellow-image information fed from exposure unit 9, an electrostatic latent image is formed on the charged surface of drum 5*a*. On developing roller 5*e,* spreading blade 5*g* evenly spreads yellow toner, which was supplied from supply roller 5*f,* and charges it by friction from the rubbing movement. Depending on the potential difference in voltage placed between drum 5*a* and developing roller 5*e,* the toner adheres to the latent image formed on drum 5*a,* and thereby the latent image becomes visible. The visualized yellow-toner image is transferred onto inter-stage transfer belt 3 by applying a high potential voltage to first transfer roller 13Y.

In tandem with the transfer process for the yellow-toner image, an electrostatic latent image for magenta is formed on drum 6*a* in image-forming unit 6. In the same manner as the process in unit 5, magenta toner evenly spread on developing roller 6*e* adheres to the magenta latent image to be visible. By application of high potential voltage to roller 13M, the visible magenta-toner image on drum 6*a* is transferred onto belt 3 that has already carried the yellow-toner image processed in unit 5, so that the magenta-toner image is overlapped with the yellow one.

Like the transfer process in units 5 and 6, the cyan-toner and the black-toner images formed in image-forming units 7 and 8 are transferred onto belt 3 by applying a high potential voltage to rollers 13C and 13B, respectively. Through these processes, belt 3 finally carries a full-color toner image thereon.

After that, as joint gear 25 rotates in reverse, guide member 19 resumes the sliding motion and moves back to the initial position—the opposite stroke end. Engaging with the sliding motion of guide member 19, guide pins 15*b* travel—just in reverse of the engaging process—the ramps of guides 16Y through 16B and return to disengaging stages 18Y through 18B. Accordingly, first transfer rollers 13Y through 13B move to the disengaging positions, allowing belt 3 to keep away from drums 5*a* through 8*a*. When belt 3 is away from drums Sa through 8*a,* all of drum motors 29Y through 29B stop their rotation, thereby all of drums 5*a* through 8*a* come to a stop, too.

When sheet P fed from paper cassette 10 passes between belt 3 and second transfer roller 11, the full-color toner image carried on belt 3 is transferred onto sheet P by one operation. The transferred image on sheet P is finally affixed with heat by fixing unit 12, and then sheet P is ejected from the apparatus. Following the completion of the series of the image-forming process, belt motor 32 stops its rotation to stop belt 3.

According to the embodiment of the present invention, as described above, running belt 3 comes into contact with rotating drums 5*a* through 8*a* only while the toner images on drums 5*a* through 8*a* are transferred to belt 3. Compared with the conventional structure in which the belt contacts with the drums all through the process, this minimized contact reduces damage or abrasion likely occurring when the drums and the belt start to rotate. As a result, degradation in image quality is substantially suppressed and the service life will be extended. Furthermore, the structure does away with the need to drive in unison belt motor 32 and drum motors 29Y through 29B, thereby promising reduced power consumption.

When belt 3 comes into contact with, or goes away from drums 5*a* through 8*a,* both devices experience impact vibrations that are small but not negligible. Therefore, if the engaging/disengaging motion is performed in the process of forming latent images onto drums 5*a* through 8*a* by exposure unit 9, the vibrations can adversely affect the sensitive latent images. Furthermore, when belt 3 goes away from drums 5*a* through 8*a,* the upper half (divided by roller 1 and roller 2) of the belt becomes momentarily shorter than the lower half, accordingly decreasing the running speed of belt 3. Therefore, if the disengaging motion is performed in the transfer process of the toner image on belt 3 onto sheet P by second transfer roller 11, the toner image on the sheet can be adversely affected.

For such reasons, according to the embodiment:

i) belt 3 is engaged with drums 5*a* through 8*a* prior to the exposure process; and ii) belt 3 is disengaged from drums 5*a* through 8*a* after transferring the toner image onto sheet P. The timing above protects the transferred result from disturbance caused by impact vibrations, realizing a clearer toner image.

Now will be described procedures for recovering from a stoppage caused by paper jamming or other operational failures that can arise in the series of the image-forming process, and the initializing operation performed at power-up of the apparatus. The description here is focused on the movement of image-forming units 5 through 8 and inter-stage transfer belt unit 21.

The main operation for initializing image-forming units 5 through 8 is to clean out the residual toner on drums 5*a* through 8*a,* which has not been transferred onto belt 3. For the cleaning, drums 5*a* through 8*a* have to be rotated at least one rotation. Similarly, the main operation for initializing belt unit 21 is to clean out the residual toner on belt 3, which has not been transferred onto sheet P.

According to the embodiment, drums 5*a* through 8*a* have 30-mm outside diameters—that is, the length of their circumferences are 94.2 mm, and close-looped belt 3 has an 848 mm circumference. Suppose that such sized drum and belt are employed for the conventional structure in which the belt contacts with the drums at all times, and that the drums and the belt rotate at a same speed with each other. In this case, drums 5*a* through 8*a* have to rotate some 9 turns while belt 3 travels one rotation for cleaning operation. This unnecessary initializing operation of units 5 through 8 adversely affects each component of the units—drums 5*a* through 8*a,* cleaning blades 5*c* through 8*c,* developing rollers 5*e* through 8*e,* supply rollers 5*f* through 8*f,* and spreading blades 5*g* through 8*g,* seriously impairing their service lives.

To address the problem, as described above, drum motors 29Y through 29B driving image-forming units 5 through 8 and belt motor 32 driving inter-stage transfer belt unit 21 are independently structured. In addition, belt 3 comes into contact with drums 5*a* through 8*a* only while accepting the toner image from drums 5*a* through 8*a*. Such structure protects units 5 through 8 from undergoing more wasteful movement than necessary to initialize operation, significantly increasing their service life.

As described earlier, the current supply reaches its peak at the moment of driving a motor. Therefore, providing all of the motors, i.e., drum motors 29Y through 29B and belt motor 32 with a time-shifted start can suppress peak power consumption. As shown in the timing chart of FIG. 10, after belt motor 32 and drum motors 29Y through 29B start in order at intervals over time, guide member 19 starts to move. It thus becomes possible to control the power consumption by driving belt motor 32 and drum motors 29Y through 29B with a time-shifted start.

Second Preferred Embodiment

Figure 11:
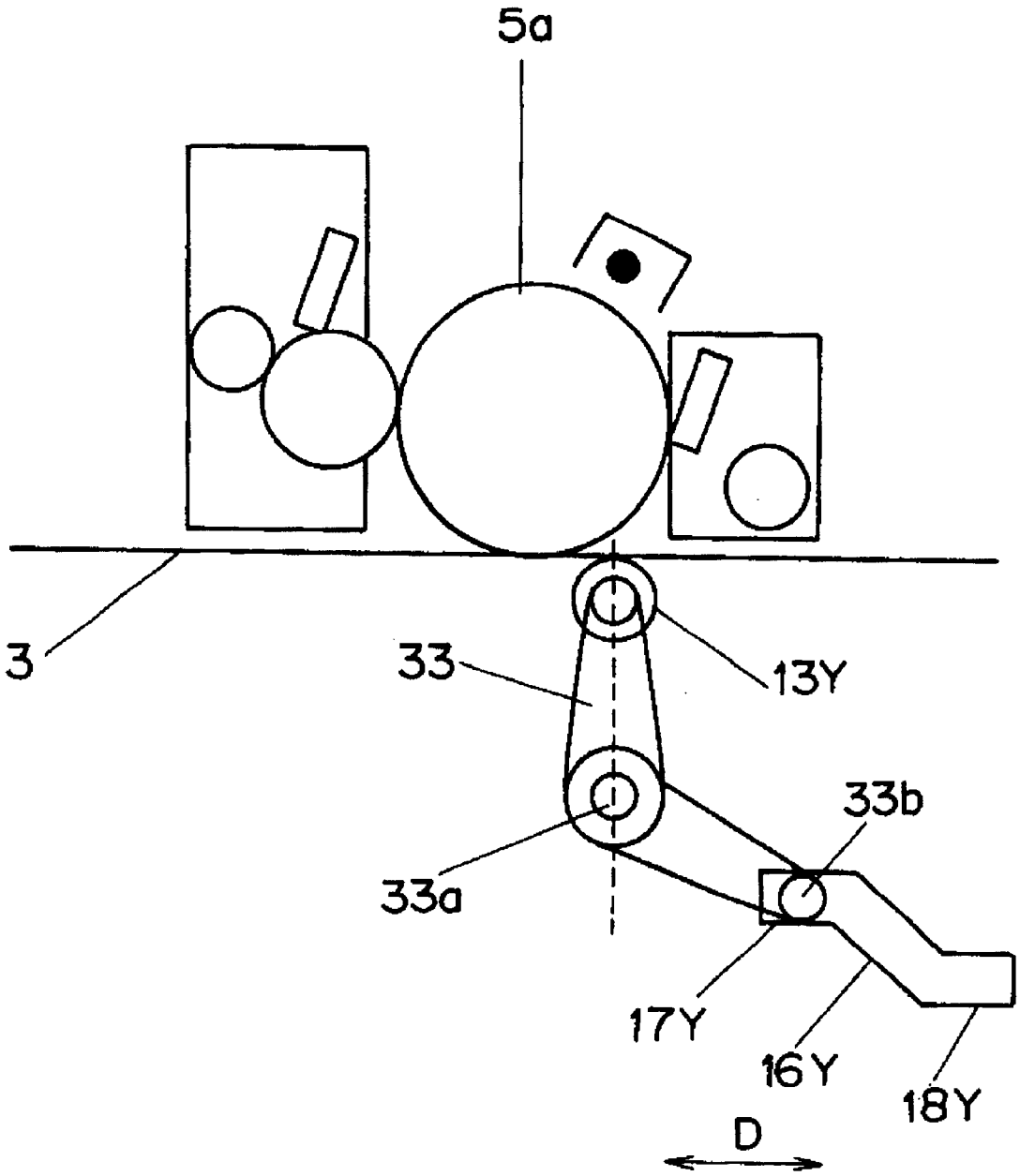
FIG. 11 schematically shows the image-forming unit for yellow and the trigger responsible thereto in accordance with a second preferred embodiment.

FIG. 11 schematically shows the image-forming unit for yellow and a trigger responsible to the unit in accordance with the second preferred embodiment.

As shown in the figure, trigger 33 is a variant of trigger 15 in FIG. 2. Having a structure basically the same as trigger 15, trigger 33 has its support pin 33*a* on the vertical of first transfer roller 13Y.

Generally L-shaped, trigger 33 rotates on support pin 33*a* fixed to the apparatus. In addition, guide pin 33*b* is disposed at a position properly spaced from support pin 33*a*. Controlling the position of guide pin 33*b* allows roller 13Y to be positioned in place.

Figure 12A:
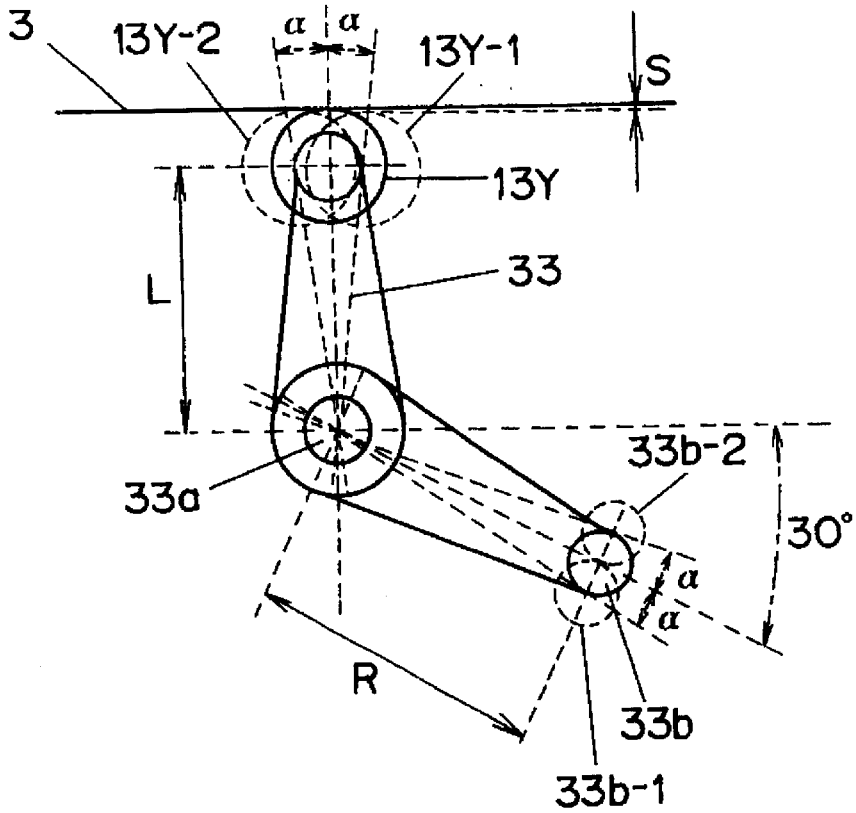
FIGS. 12(*a*) and 12(*b*) illustrate variations occurring when the first transfer roller comes into contact with the inter-stage transfer belt, comparing the cases in which two different types of triggers of the present invention are used.
Figure 12B:
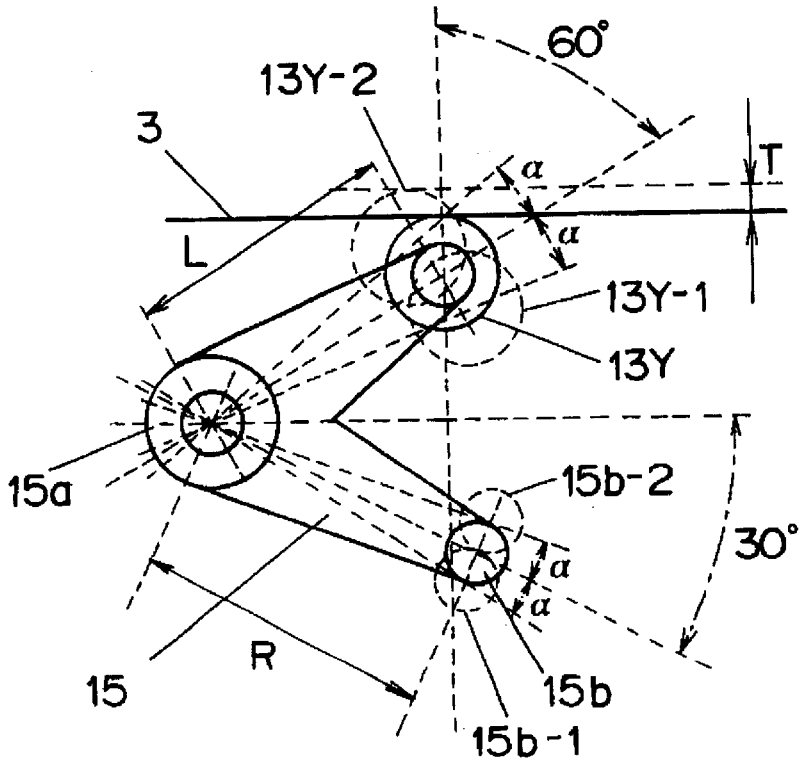

FIGS. 12(*a*) and 12(*b*) illustrate variations occurringwhen the first transfer roller comes into contact with the inter-stage transfer belt, comparing the use of the trigger of the second embodiment with another type trigger of the first preferred embodiment.

In trigger 33 of FIG. 12(*a*), support pin 33*a* is spaced distance L from roller 13Y in a vertically downward direction, while guide pin 33*b* is disposed at a position keeping distance R equal to distance L and being angled at 30° from the horizontal. In the structure, positional errors can be caused from variations in the molding process of trigger 33 and guide member 19, deflections occurring when guide-holding pin 23 fits in guide member 19, or guide pin 33*b* fits into the slot of guide member 19. The displacement caused above allows the precisely designed position to is within $\pm\alpha$ a angled deflections. First transfer roller 13Y accordingly have within $\pm\alpha$ angled deflections with respect to its normal position. In the figure, when guide pin 33*b* is placed at the position indicated by the numeral 33*b*-1, roller 13Y is moved to the position indicated by the numeral 13Y-1. Similarly, moving guide pin 33*b* to the position 33*b*-2 locates roller 13Y at the position 13Y-2.

On the other hand, in trigger 15 of FIG. 12(*b*), support pin 15*a* is disposed on the line with a 60° angle to the vertical that passes through the center of roller 13Y and is spaced a distance L from the center. Guide pin 15*b* is disposed at a position keeping distance R equal to distance L and being angled at 30° from the horizontal. Like trigger 33, positional errors allow the precisely designed position to be within $\pm\alpha$ angled deflections. First transfer roller 13Y accordingly is within ±α angled deflections with respect to its normal position. In the figure, when guide pin 15*b* is placed at the position indicated by the number 15*b*-1, roller 13Y is moved to the position indicated by the number 13Y-1. Similarly, moving the guide pin 15*b* to the position 15*b*-2 locates roller 13Y at the position 13Y-2.

In the structure having such deflections, the key to a good transfer is to minimize variations in bite between drum 5*a* and belt 3. The difference in bite causes an inconsistent toner image transferred from drum 5*a,* and particularly when a fixed high voltage is applied to roller 13Y, the form of transferred toner image will be distorted. To avoid such inconveniences, in both cases of roller 13Y shown in FIG. 12, it is required to minimize the displacement S—between the normal position and the deflected position indicated by the numeral 13Y-1 shown in FIG. 12(*a*)—and the displacement T—between the normal position and the deflected position indicated by the numeral 13Y-2 shown in FIG. 12(*b*), respectively.

Variations in position of guide pin 33*b* develop the displacement S in FIG. 12(*a*), while variations in position of guide pin 15*b* develop the displacement T in FIG. 12(*b*). As is evident from both figures, the displacement observed in FIG. 12(*b*) is larger than that in FIG. 12(*a*). When performing a simulation on condition that L=R=40 (mm) and α=1, the following is the result: S=0.006 (mm) and T=0.602 (mm). It is apparent from the result that T takes the value ten times greater than S does.

Therefore, disposing support pin 33*a* in a vertically downward direction with respect to roller 13Y ensures that the toner image on drum 5*a* is transferred in a good condition. This is also true for each trigger 15 responsible to rollers 13M through 13B.

Third Preferred Embodiment

Figure 13:
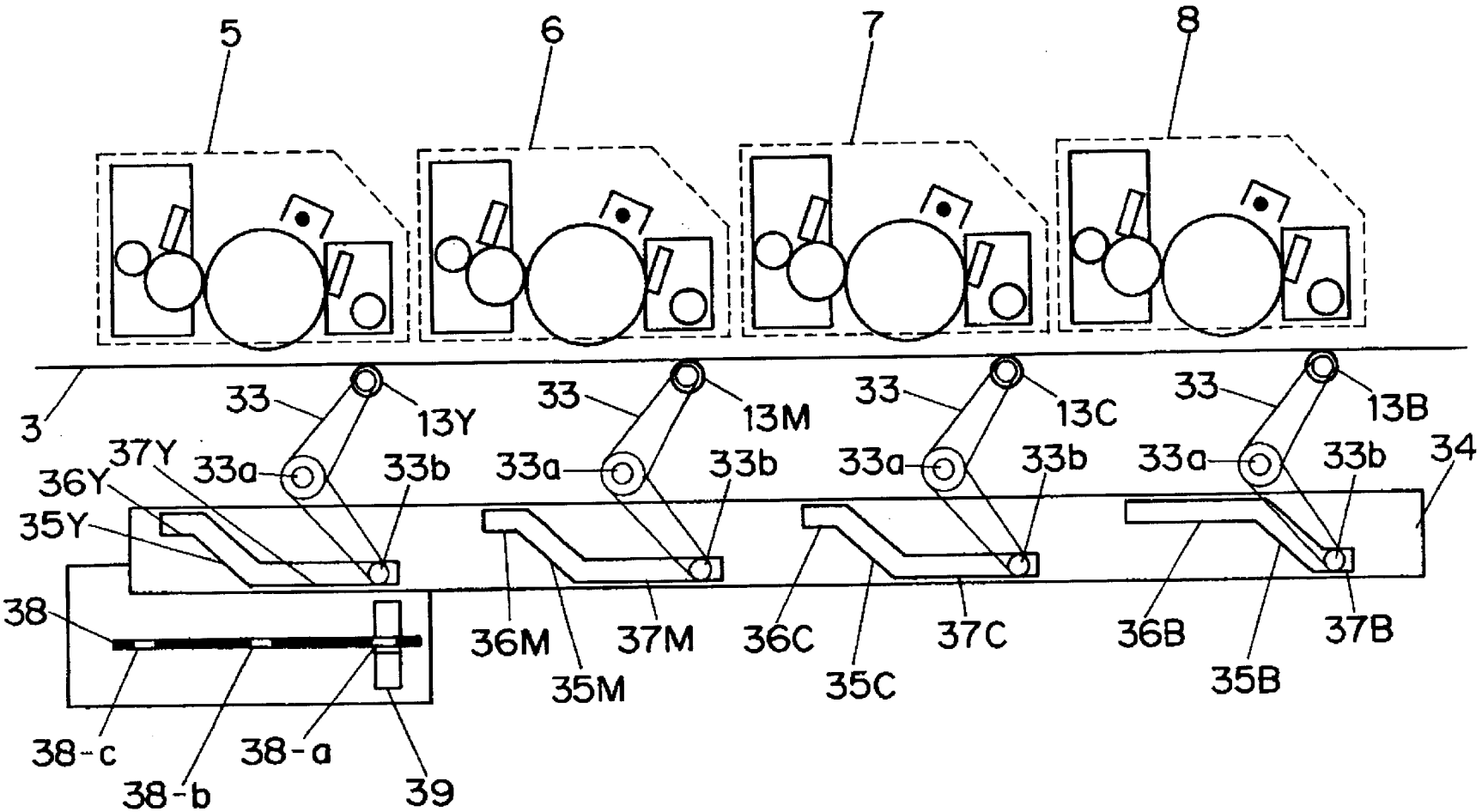
FIG. 13 is a schematic view of the apparatus, specifically showing the engaging relation between the trigger and the guide member when all of the first transfer rollers stay in the disengaging positions in accordance with a third preferred embodiment of the present invention.

FIG. 13 is a schematic view of the image-forming apparatus, specifically showing the engaging relation between trigger and a guide member when all of the first transfer rollers stay in the disengaging positions in accordance with a third preferred embodiment of the present invention.

Figure 14:
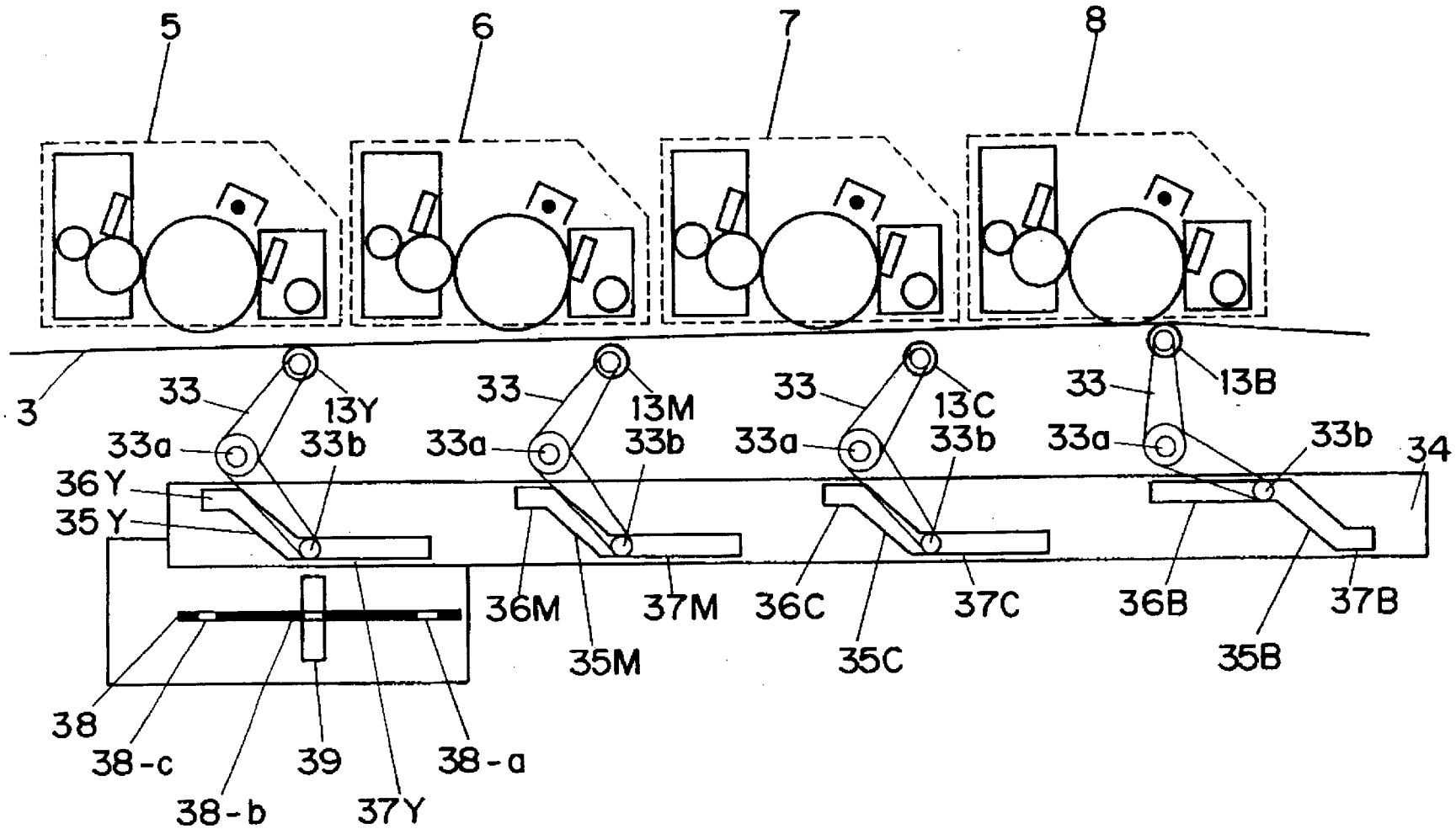
FIG. 14 is a schematic view of the apparatus, specifically showing the engaging relation between the trigger and the guide member when the first transfer roller responsible for black alone stays in the engaging position.

FIG. 14 is a schematic view showing the engaging relation between the trigger and the guide member when the first transfer roller responsible for black alone stays in the engaging position.

Figure 15:
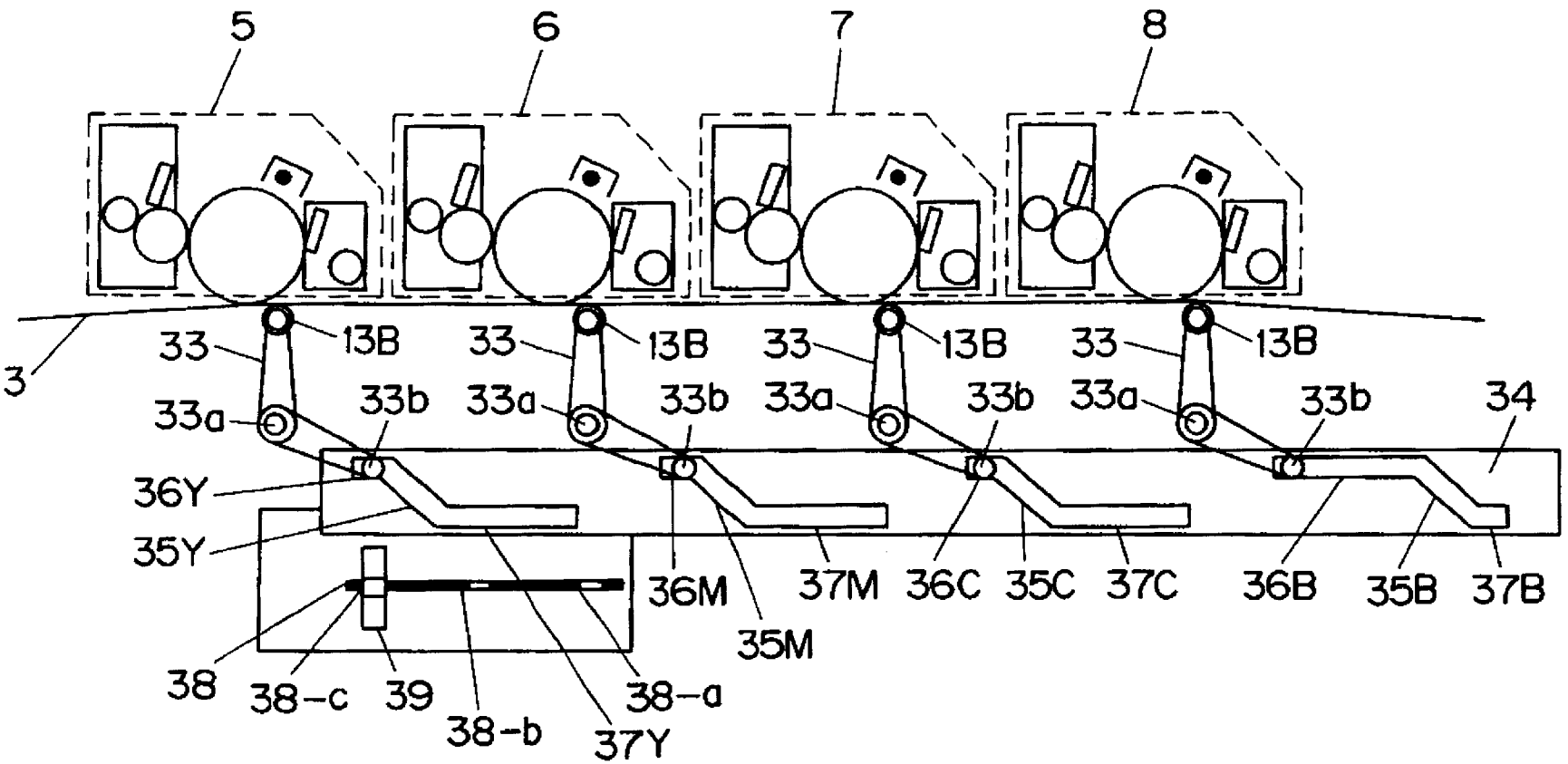
FIG. 15 is a schematic view of the apparatus, specifically showing the engaging relation between the trigger and the guide member when all of the first transfer rollers stay in the engaging positions.

FIG. 15 is a schematic view showing the engaging relation between the trigger and the guide member when all of the first transfer rollers stay in the engaging positions.

Each structure of image-forming units 5 through 8 shown in FIGS. 13 through 15 is the same as that described earlier, arranged in the order of yellow (Y), magenta (M), cyan (C), and black (B) from left to right in each figure. Correspondingly disposed for respective units 5 through 8, rollers 13Y through 13B are held at both ends by triggers 33 described in FIG. 11. Trigger 33 can be replaced with trigger 15 described above. Like guide member 19, guide member 34 includes guides 35Y, 35M, 35C, and 35B and is movable in the lateral direction. Each of guides 35Y through 35B has i) engaging stages 36Y, 36M, 36C, 36B and ii) disengaging stages 37Y, 37M, 37C, 37B.

In these figures, guide 35B working for unit 8 for black (B) differs in its shape from other guides 35Y through 35C working for units 5 through 7. Guide 35B has engaging stage 36B whose length is longer than those of engaging stages 36Y through 36C by a specified length, while guides 35Y through 35C have disengaging stages whose lengths are longer than that of disengaging stage 37B by a specified length.

Figure 16:
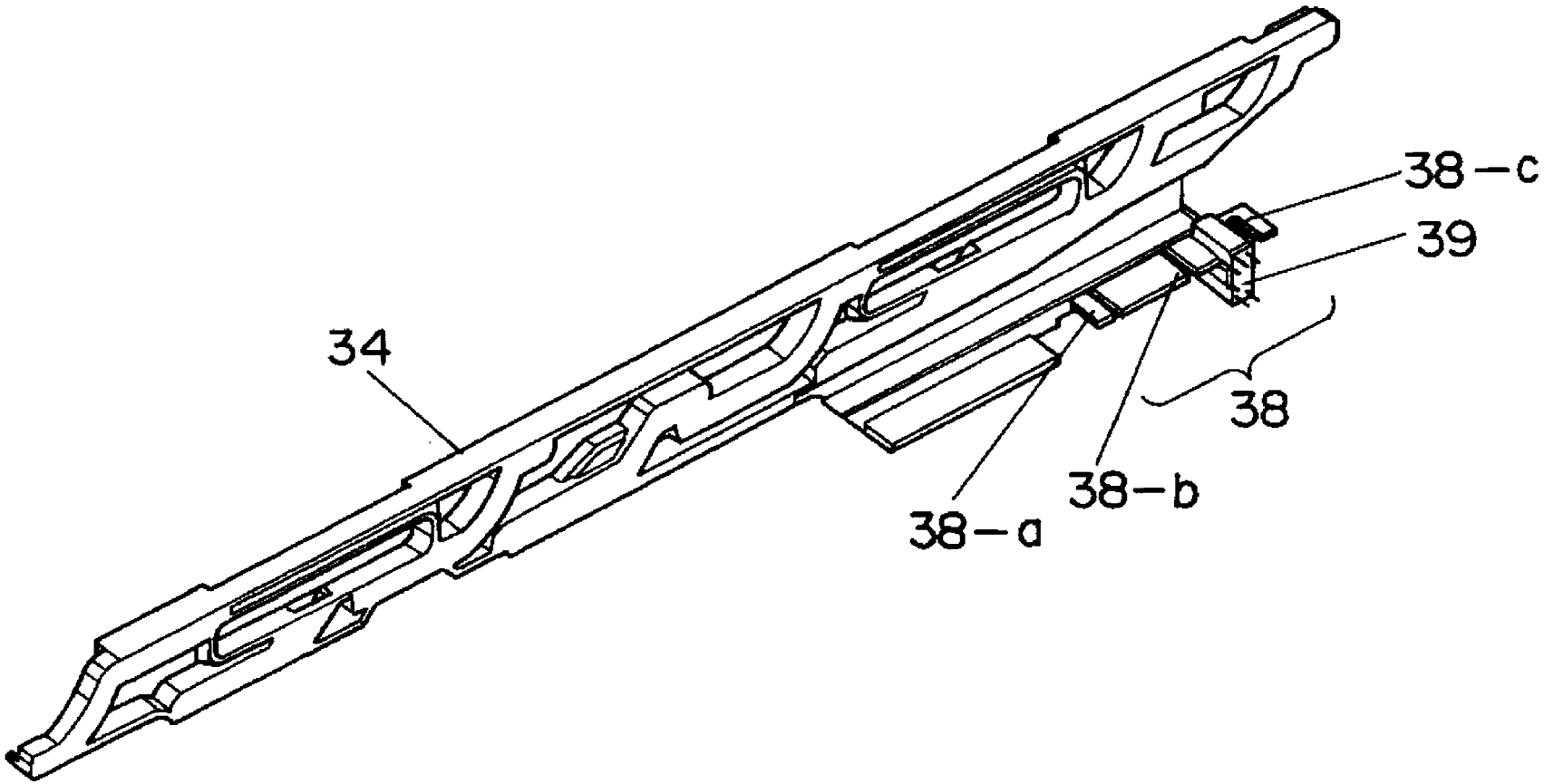
FIG. 16 is a perspective view indicating the positional relation between the guide member and the sensorin the apparatus.

FIG. 16 is a perspective view indicating the positional relation between the guide member and the sensor in the image forming apparatus.

Sensor 39 is disposed on the side of the apparatus (not shown). Having a pass-through type detector, sensor 39 outputs transmitted light in the direction vertically to the moving direction of sensing opening 38. Slits 38-*a,* 38-*b,* and 38-*c,* which are disposed at opening 38, determine the stop position of guide member 34.

FIGS. 13 through 15 also show the relationship among slits 38-*a* through 38-*c,* sensor 39, and guide member 34. FIG. 13 shows the state in which slit 38-*a* is in alignment with the optical axis of sensor 39. FIG. 14 shows the state in which guide member 34 has a rightward shift from the state shown in FIG. 13 and slit 38-*b* comes in alignment with the optical axis of sensor 39. FIG. 15 shows the state in which guide member 34 goes farther rightward from the state shown in FIG. 14 and slit 38-*c* comes in alignment with the optical axis of sensor 39.

As described earlier, FIG. 13 shows the state that all of the first transfer rollers stay in the disengaging positions. Under this state, slit 38-*a* is in alignment with the optical axis of sensor 39. As guide member 34 shifts rightward from this state at a fixed speed, guide pin 33*b* of trigger 33 working for unit 8 for black (B) slides the ramp of guide 35B up to engaging stage 36B. Guide member 34 comes to a stop, with slit 38-*b* being in alignment with the optical axis of sensor 39. In the meantime, trigger 33 rotates on support pin 33 a in a counterclockwise direction, by which roller 13B reaches the engaging position while pushing up inter-stage transfer belt 3. In contrast to the movement of guide pin 33*b* for unit 8, other guide pins 33*b* —working for rollers 13Y through 13C—only move on respective disengaging stages 37Y, 37M, 37C, with no contribution to the rotation of trigger 33. Therefore, belt 3 comes into contact with only drum 8*a* responsible for black (B), allowing the black-toner image only to be transferred. During the transfer process of the black-toner image, other units 5 through 7 can be at rest. That is, this operation is effective in forming a monochrome image. On the completion of the monochrome-image forming, guide member 34 shifts back leftward and stops with roller 13Y through 13B shown in FIG. 13 being in the disengaging positions.

Now will be described the movement in forming color images. To perform the color-image transfer, rollers 13Y through 13B have to leave the disengaging positions and go into the state shown in FIG. 15 via the state in FIG. 14 described above. This will be explained in some detail. Guide member 34 starts to shift rightward from the state in which slit 38-*a* is in alignment with the optical axis of sensor 39 shown in FIG. 13. At this time, guide member 34 stops at a position in which slit 38-*c* after passing through a position in which slit 38-*b* is aligned with sensor 39. When guide member 34 passes through the position in which slit 38-*b* is aligned with sensor 39, roller 13B comes into its engaging position. A farther leftward shift of guide member 34 brings guide pins 33*b* of each trigger 33 for respective rollers 13Y through 13C to engaging stages 36Y through 36C via ramps of guides 35Y through 35C. Following roller 13B, roller 13Y through 13C come into each engaging position and thereby belt 3 comes into a contact with all drums 5*a* through 8*a*. In this way, a color-toner image can be formed. When the image forming is completed, the guide member and other involved components follow the reverse procedure to get back to the initial state.

As described above, in the structure of the embodiment, i) guide 35B for black (B) differs in shape from other guides 35Y through 35C; ii) having such structured guides 35Y through 35B, guide member 34 shifts in a step-by-step manner. With the structure, the two modes—monochrome-image forming and color-image forming—can be selectively performed. When forming a monochrome image, other image-forming units—units 5, 6, 7 for yellow (Y), magenta (M), cyan (C), respectively—can be at rest. This improvement in printing a monochrome-image independently without wasteful movement of other units increases the longevity of units 5 through 7.

Although units 5 through 8 are arranged in order of yellow (Y), magenta (M), cyan (C), black (B) from left to right in FIGS. 13 through 15, the arrangement is not limited to this: any arrangement will be acceptable as long as the position of guide 35B of guide member 34 corresponds to the position of image-forming unit for black (B).

Fourth Preferred Embodiment

Figure 17:
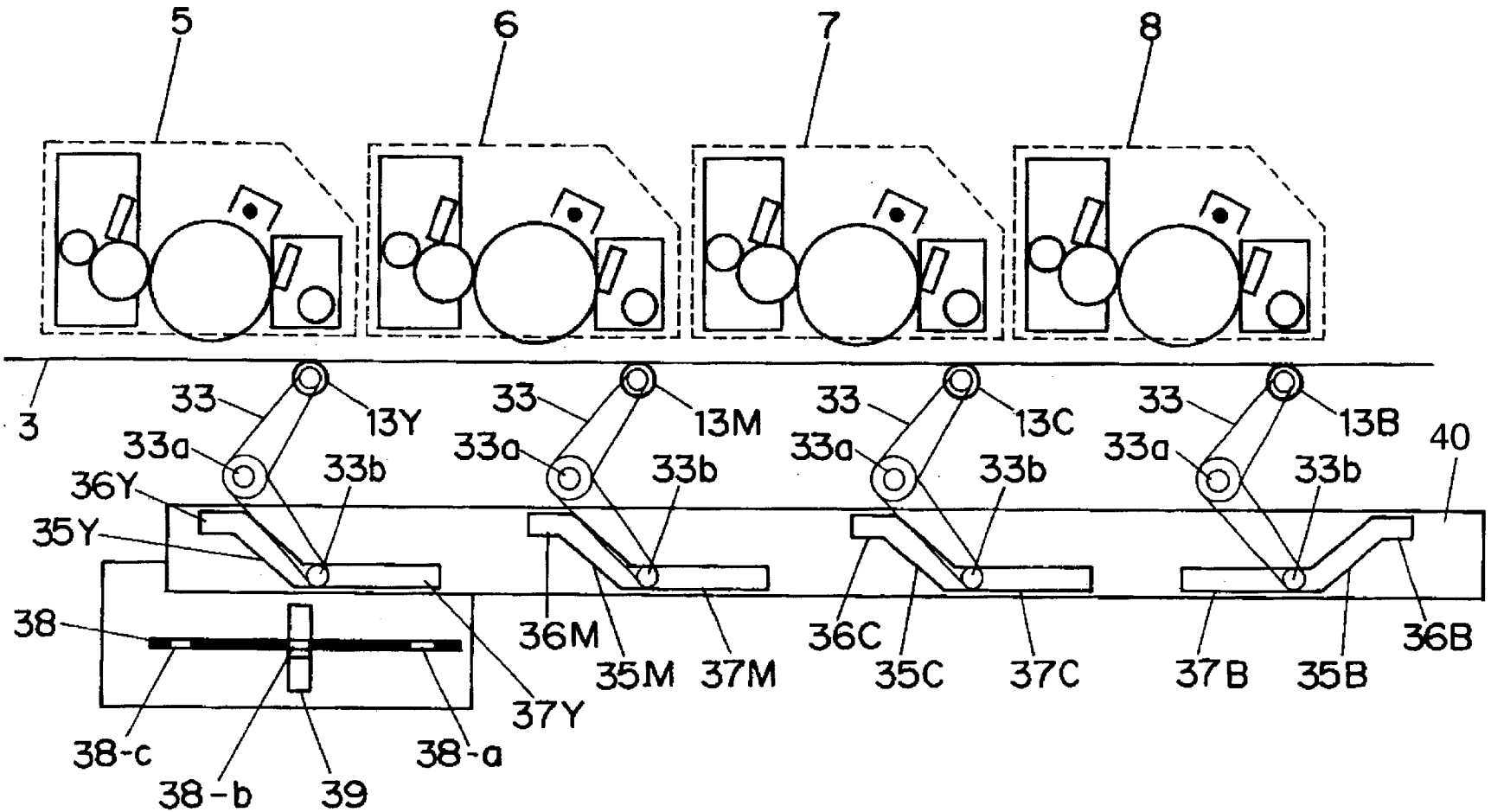
FIG. 17 is a schematic view of the apparatus, specifically showing the engaging relation between the trigger and the guide member when all of the first transfer rollers stay in the disengaging positions in accordance with a fourth preferred embodiment of the present invention.

FIG. 17 is a schematic view of the image-forming apparatus, specifically showing the engaging relation between triggers and a guide member when all of the first transfer rollers stay in the disengaging positions in accordance with a fourth preferred embodiment of the present invention.

Figure 18:
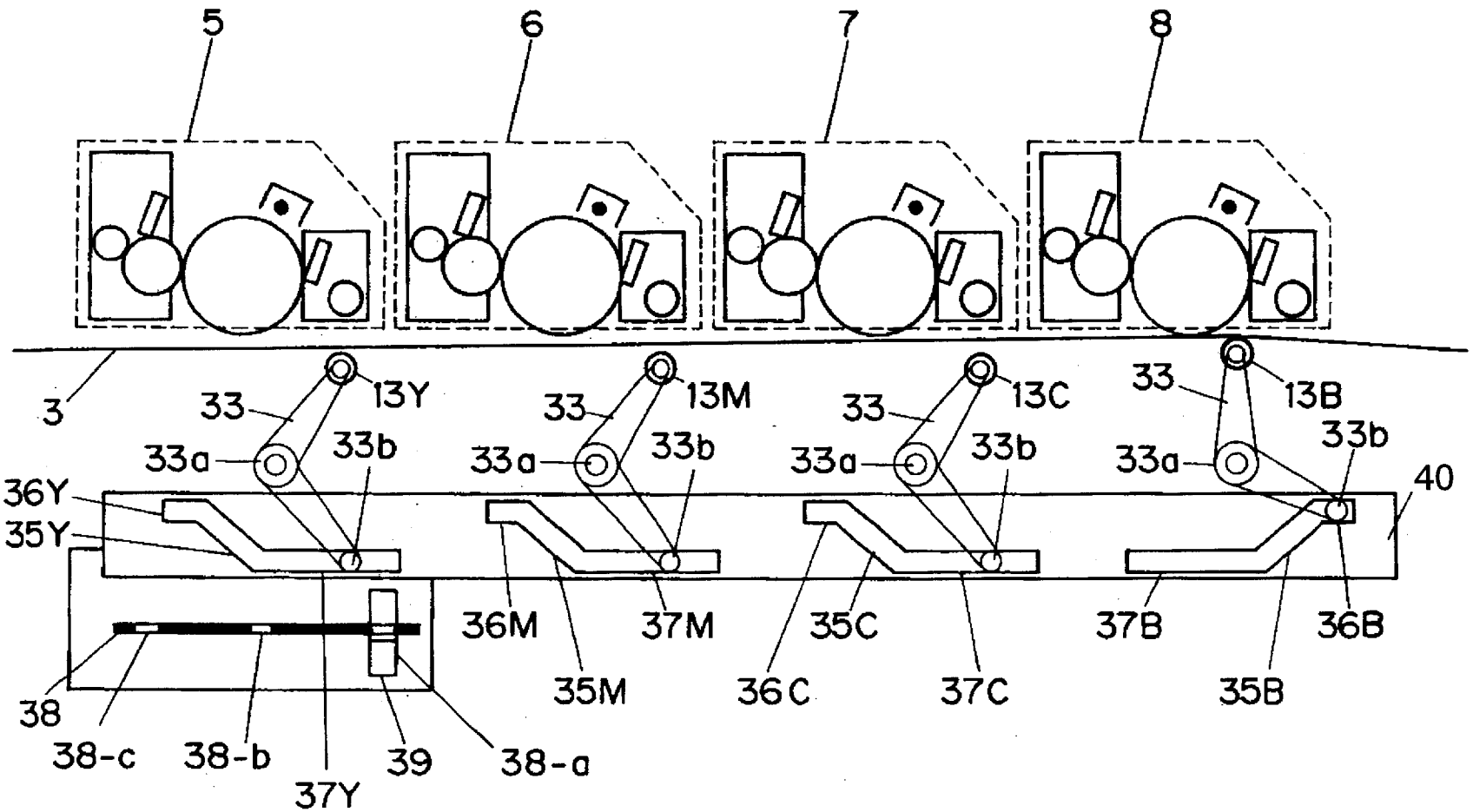
FIG. 18 is a schematic view of the apparatus, specifically showing the engaging relation between the trigger and the guide member when the first transfer roller for black alone stays in the engaging position.

FIG. 18 is a schematic view showing the engaging relation between the triggers and the guide member when the first transfer roller responsible for black alone stays in the engaging position.

Figure 19:
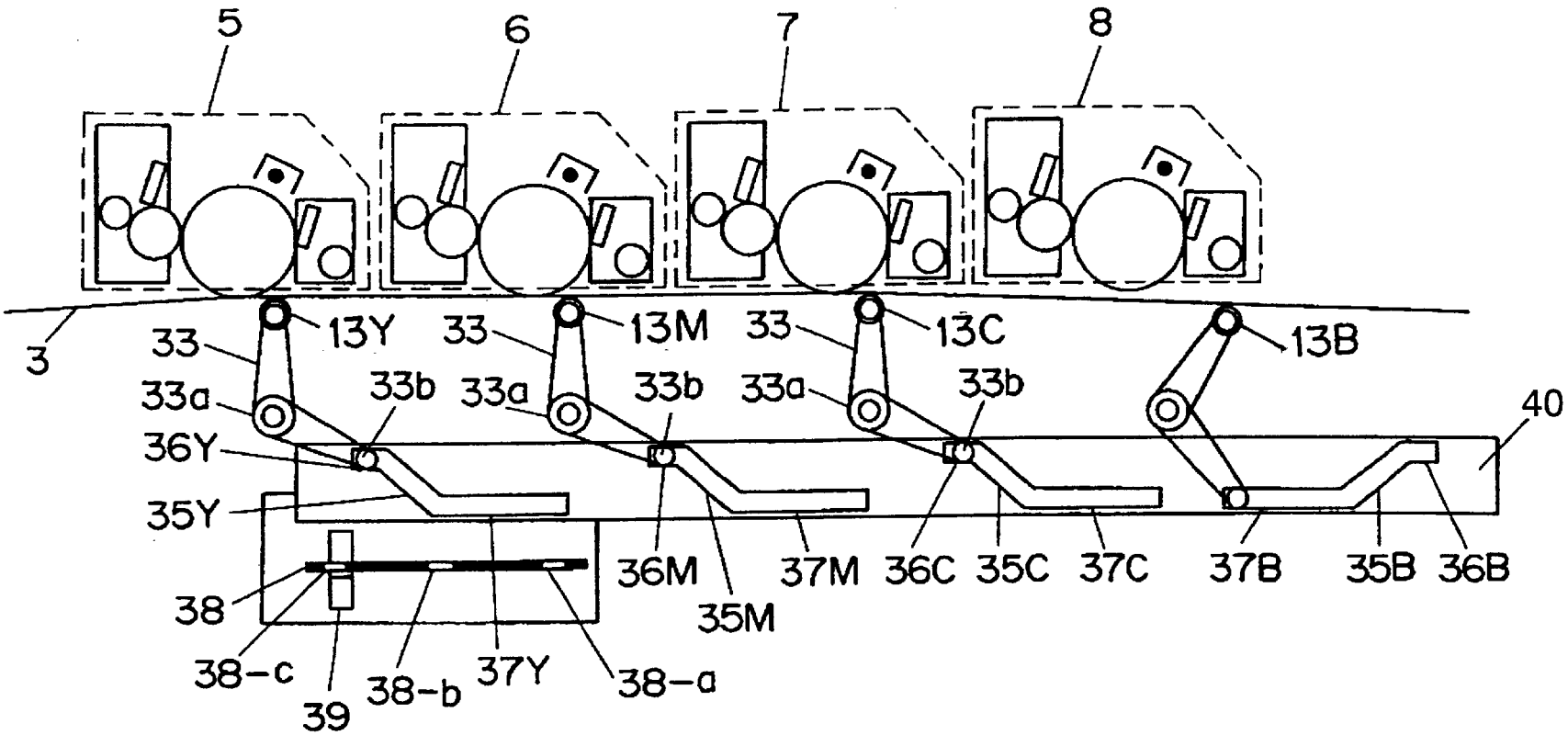
FIG. 19 is a schematic view of the apparatus, specifically showing the engaging relation between the trigger and the guide member when all the first transfer rollers but the roller for black stay in the engaging positions.
Figure 20:
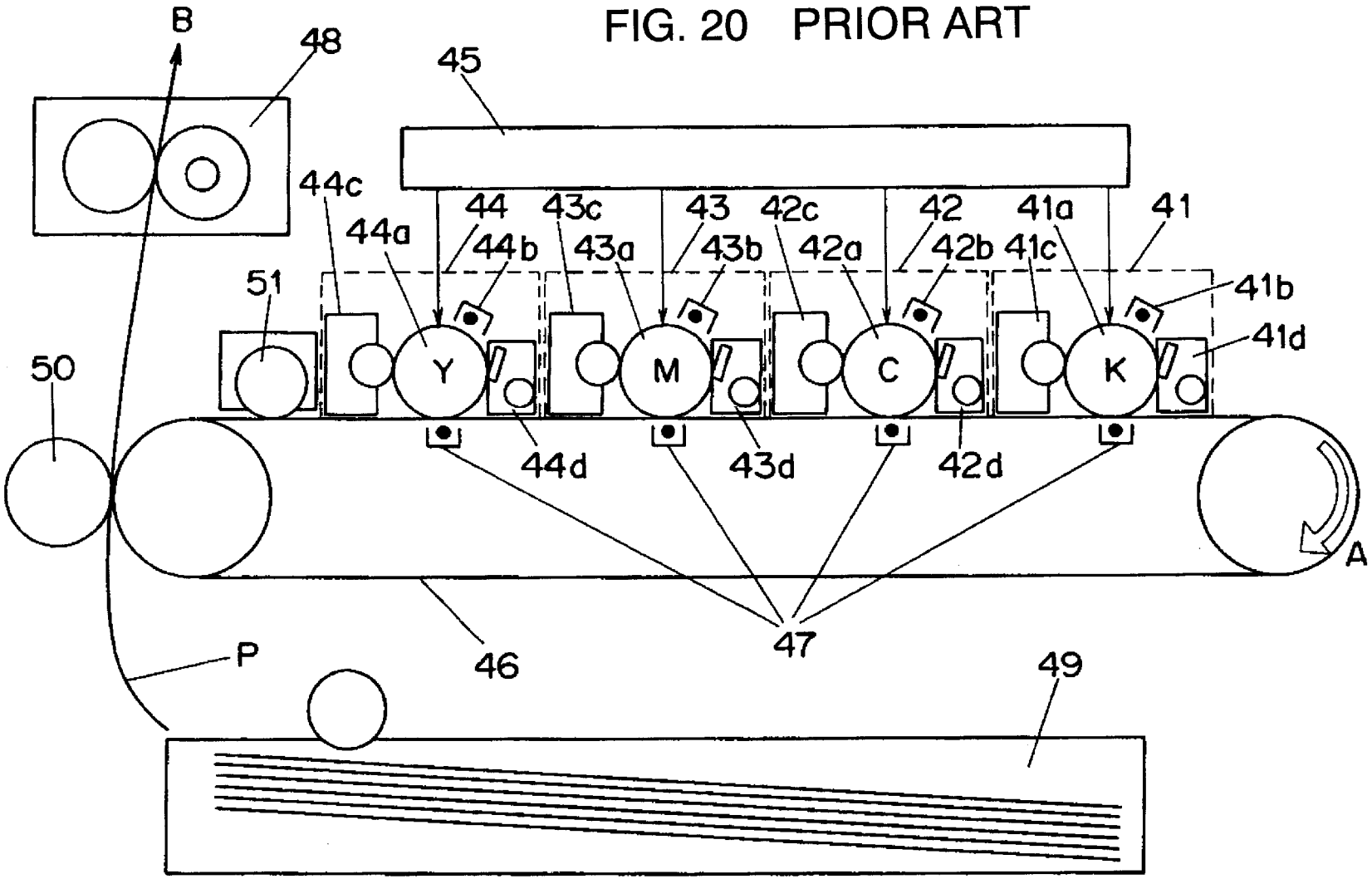
FIG. 20 PRIOR ART
FIG. 20 is a schematic view of the prior-art color-image forming apparatus.

FIG. 19 is a schematic view showing the engaging relation between the triggers and the guide member when all the first transfer rollers but the roller for black stay in the engaging positions.

Each structure of image-forming units 5 through 8 shown in FIGS. 17 through 19 is the same as that described earlier, arranged in the order of yellow (Y), magenta (M), cyan (C), and black (B) from left to right in each figure. Correspondingly disposed for respective units 5 through 8, rollers 13Y through 13B have triggers 33 the same as those shown in FIGS. 13 through 15. Like guide member 34, guide member 40 includes guides 35Y, 35K 35C, and 35B and is movable in the lateral direction. Each of guides 35Y through 35B has i) engaging stages 36Y, 36M, 36C, 36B and ii) disengaging stages 37Y, 37M, 37C, 37B.

According to the embodiment, guide 35B corresponding to unit 8 for black (B) is disposed in symmetrical relation to the positioning of other guides 35Y through 35C corresponding to units 5, 6, 7 for yellow (Y), magenta (M), cyan (C), respectively. For such arrangement, the engaging relation in the initial state between guide pin 33*b* and guide 35B differs from that between other guides and each guide pin 33*b*. Sensor 39, which senses the shift position of guide member 40, and sensing opening 38 of guide member 40 are structured in a manner similar to those shown in FIG. 16. The linkage movement between guide member 40 and triggers 33 is basically the same as that shown in FIGS. 13 through 15.

Sensor 39 senses slit 38-*b* in FIG. 17. This is the initial state in which rollers 13Y through 13B stay in the disengaging positions. To form a monochrome image, guide member 40 shifts toward the left at a fixed speed until sensor 39 senses slit 38-*a*. While shifting, guide pin 33*b* of trigger 33 working for unit 8 for black (B) slides the ramp of guide 35B up to engaging stage 36B. In the meantime, trigger 33 rotates on support pin 33*a* in a counterclockwise direction, by which roller 13B reaches the engaging position shown in FIG. 18 while pushing up inter-stage transfer belt 3.

In contrast to the movement of guide pin 33*b* of trigger 33 for roller 13B, other guide pins 33*b* —working for rollers 13Y through 13C—only move on respective disengaging stages 37Y, 37M, 37C, with no contribution to the rotation of trigger 33. Therefore, belt 3 comes into contact with only drum 8*a* responsible for black (B), allowing the black-toner image only to be transferred. During the transfer process of the black-toner image, other units 5 through 7 can be at rest. On the completion of the monochrome-image forming, guide member 40 in FIG. 18 shifts back rightward. When slit 38-*b* comes in alignment with the optical axis of sensor 39, guide member 40 stops with roller 13B shown in FIG. 17 settled in the disengaging position.

Here will be described the movement in forming color images. Guide member 40 now shifts toward the right at a fixed speed until sensor 39 senses slit 38-*c*. In the meantime, triggers 33 corresponding to units 5, 6, 7 for yellow (Y), magenta (M), cyan (C), respectively, rotate on support pins 33*a*, and thereby rollers 13Y through 13C move into the engaging positions. In contrast to the movement of guide pins 33*b* of triggers 33 for rollers 13Y through 13C, guide pin 33*b* working for roller 13B only moves on disengaging stage 37B without causing rotation of its own trigger 33. Therefore, belt 3 comes into contact with drums 5*a* through 7*a*, which are at-least-needed for color-image forming. When the image forming is completed, the guide member and other involved components follow the reverse procedure to get back to the initial state.

As described above, in the structure of the embodiment, guide 35B for black (B) differs in shape from other guides 35Y through 35C. Having such structured guides thereon, guide member 40 shifts toward right or left from the initial state according to the two modes of monochrome-image forming and color-image forming.

According to the structure, image-forming unit 8 for black (B) can be at rest during the color-image forming. This promises an increased service life of unit 8. Although units 5 through 8 are arranged in order of yellow (Y), magenta (M), cyan (C), black (B) from left to right in FIGS. 17 through 19, the arrangement is not limited to this; any arrangement will be acceptable as long as the position of guide 35B of guide member 40 corresponds to the position of image-forming unit for black (B).

According to the present invention, as described above, the inter-stage transfer belt comes into contact with the photosensitive drum only while the toner image on the drum is transferred onto the belt, minimizing damage or abrasion caused from rubbing against each other. It thus becomes possible to greatly increase the longevity of the photosensitive drum that is the "heart" of the image-forming unit. It also contributes to an extended service life of the drum and the belt for precisely controlled image quality.

What is claimed is:

1. A color-image forming apparatus comprising:

an exposure unit;

plural image-forming units arranged in a tandem manner and having different color toners therein, respectively, each of said image-forming units including a photosensitive drum on which an electrostatic latent image is formed by the exposure unit, and a developing unit for forming a toner image by applying toner onto the latent image; and an endless inter-stage transfer belt for transferring plural toner images of different colors formed on said drums by overlapping one after another while traveling an endless path looped over plural rollers along a direction of an arrangement of the image-forming units;

wherein the inter-stage transfer belt comes into contact with the photosensitive drums only while accepting the toner image formed on the photosensitive drums;

wherein both of engaging and disengaging motions between the inter-stage transfer belt and the photosensitive drums are performed while the belt and the drums are both in operation; and wherein a belt-drive unit for running the inter-stage transfer belt and a drum-drive unit for rotating the photosensitive drums that carry the plural images of different colors are independently structured, and the belt-drive unit and the drum-drive unit are to be driven in order with time-shifted starts.

2. The color-image forming apparatus of claim 1, wherein the inter-stage transfer belt comes into contact with the photosensitive drums prior to an exposure process by the exposure unit, and goes away from the drums after the color toner image is transferred by one operation onto a recording material.

3. A color-image forming apparatus comprising:

an exposure unit;

plural image-forming units arranged in a tandem manner and having different color toners therein, respectively, each of said image-forming units including a photosensitive drum on which an electrostatic latent image is formed by the exposure unit, and a developing unit for forming a toner image by applying toner onto the latent image; and an endless inter-stage transfer belt for transferring plural toner images of different colors formed on said drums by overlapping one after another while traveling an endless path looped over plural rollers along a direction of an arrangement of the image-forming units;

wherein the inter-stage transfer belt comes into contact with the photosensitive drums only while accepting the toner image formed on the photosensitive drums;

wherein plural movable rollers are arranged, on the side of an inner circumference of the inter-stage transfer belt, at positions corresponding to positions of the photosensitive drums, respectively, and the movable rollers are disposed to be movable in a direction toward the drums such that the inter-stage transfer belt comes into contact with the photosensitive drums to transfer a toner image formed on the photosensitive drums onto the inter-stage transfer belt one upon another for forming a full-color image;

wherein a guide member moveable back and forth is disposed along a direction of a layout of the image-forming units, plural triggers support the moveable rollers and rotate with the back-and-forth motion of the guide member, and rotation of the triggers caused by the guide member provides the movable roller's movement toward the drums with a rotary control, allowing the inter-stage transfer belt to come into contact with the photosensitive drums.

4. The color-image forming apparatus of claim 3, wherein the movable rollers are made of metal.

5. The color-image forming apparatus of claim 4, wherein a transfer voltage is applied to the movable rollers to transfer the toner images on the photosensitive drums onto the inter-stage transfer belt.

6. The color-image forming apparatus of claim 3, wherein a transfer voltage is applied to the movable rollers to transfer the toner images on the photosensitive drums onto the inter-stage transfer belt.

7. The color-image forming apparatus of claim 3, wherein each of the plural triggers includes a shaft-support section of the movable roller and a support-point section on which the trigger rotates, the shaft-support section and the support-point section generally lie on a vertical line when the inter-stage transfer belt comes into contact with the photosensitive drums.

8. The color-image forming apparatus according to claim 3, wherein the movable rollers, which are disposed corresponding to the plural image-forming units, respectively, move with a same timing.

9. The color-image forming apparatus according to claim 3, wherein the movable rollers, which are disposed according to the plural image-forming units, move with a same timing.

10. The color-image forming apparatus according to claim 3, wherein the plural image-forming units include a monochrome-image forming unit and at least two different color-image forming units, in a monochrome-image forming process, of the movable rollers, one that corresponds to the monochrome-image forming unit moves alone to allow the inter-stage transfer belt to contact with the photosensitive drum; and in a color-image forming process, all of the movable rollers move to allow the inter-stage transfer belt to contact with the photosensitive drums.

11. The color-image forming apparatus according to claim 3, wherein the plural image-forming units include a monochrome-image forming unit and at least different two color-image forming units, in a monochrome-image forming process, of the movable rollers, one that corresponds to the monochrome-image forming unit moves alone to allow the inter-stage transfer belt to contact with the photosensitive drum;

in a color-image forming process, all of the movable rollers but one that corresponds to the monochrome-image forming unit move to allow the inter-stage transfer belt to contact with the photosensitive drums.

12. A color-image forming apparatus comprising:

an exposure unit;

plural image-forming units arranged in a tandem manner and having different color toners therein, respectively, each of said image-forming units including a photosensitive drum on which an electrostatic latent image is formed by the exposure unit, and a developing unit for forming a toner image by applying toner onto the latent image; and an endless inter-stage transfer belt for transferring plural toner images of different colors formed on said drums by overlapping one after another while traveling an endless path looped over plural rollers along a direction of an arrangement of the image-forming units;

wherein the inter-stage transfer belt comes into contact with the photosensitive drums only while accepting the toner image formed on the photosensitive drums;

wherein plural movable rollers are arranged, on the side of an inner circumference of the inter-stage transfer belt, at positions corresponding to positions of the photosensitive drums, respectively, and the movable rollers are disposed to be movable in a direction toward the drums such that the inter-stage transfer belt comes into contact with the photosensitive drums to transfer a toner image formed on the photosensitive drums onto the inter-stage transfer belt one upon another for forming a full-color image;

wherein the plural image-forming units include a monochrome-image forming unit and at least two different color-image forming units, in a monochrome-image forming process, of the movable rollers, one that corresponds to the monochrome-image forming unit moves alone to allow the inter-stage transfer belt to contact with the photosensitive drum; and in a color-image forming process, all of the movable rollers move to allow the inter-stage transfer belt to contact with the photosensitive drums.

13. A color-image forming apparatus comprising:

an exposure unit;

plural image-forming units arranged in a tandem manner and having different color toners therein, respectively, each of said image-forming units including a photosensitive drum on which an electrostatic latent image is formed by the exposure unit, and a developing unit for forming a toner image by applying toner onto the latent image; and an endless inter-stage transfer belt for transferring plural toner images of different colors formed on said drums by overlapping one after another while traveling an endless path looped over plural rollers along a direction of an arrangement of the image-forming units;

wherein the inter-stage transfer belt comes into contact with the photosensitive drums only while accepting the toner image formed on the photosensitive drums;

wherein plural movable rollers are arranged, on the side of an inner circumference of the inter-stage transfer belt, at positions corresponding to positions of the photosensitive drums, respectively, and the movable rollers are disposed to be movable in a direction toward the drums such that the inter-stage transfer belt comes into contact with the photosensitive drums to transfer a toner image formed on the photosensitive drums onto the inter-stage transfer belt one upon another for forming a full-color image;

wherein the plural image-forming units include a monochrome-image forming unit and at least two different color-image forming units, in a monochrome-image forming process, of the movable rollers, one that corresponds to the monochrome-image forming unit moves alone to allow the inter-stage transfer belt to contact with the photosensitive drum; and in a color-image forming process, all of the movable rollers but one that corresponds to the monochrome-image forming unit move to allow the inter-stage transfer belt to contact with the photosensitive drums.

* * * * *

UNITED STATES PATENT AND TRADEMARK OFFICE

CERTIFICATE OF CORRECTION

PATENT NO. : 6,470,166 B2
DATED : October 22, 2002
INVENTOR(S) : Yoshihiro Mizoguchi et al.

It is certified that error appears in the above-identified patent and that said Letters Patent is hereby corrected as shown below:

Column 16,
Line 31, insert -- and -- after semicolon.

Signed and Sealed this

Eleventh Day of March, 2003

JAMES E. ROGAN
*Director of the United States Patent and Trademark Office*